US011021843B2

(12) United States Patent
Sung et al.

(10) Patent No.: US 11,021,843 B2
(45) Date of Patent: Jun. 1, 2021

(54) ENERGY ABSORBING POST HAVING SLIDING RAIL ASSEMBLY

(71) Applicants: KOREA INSTITUTE OF CIVIL ENGINEERING AND BUILDING TECHNOLOGY, Goyang-si (KR); KONGJU NATIONAL UNIVERSITY INDUSTRY-UNIVERSITY COOPERATION FOUNDATION, Gongju-si (KR)

(72) Inventors: Jung-Gon Sung, Goyang-si (KR); Duk-Geun Yun, Goyang-si (KR); Jae-Hong Park, Goyang-si (KR); Suk-Ki Lee, Gimpo-si (KR); Jae-Pil Moon, Seoul (KR); Choong-Heon Yang, Paju-si (KR); Man-Gi Ko, Cheonan-si (KR); Kee-Dong Kim, Dajeon (KR); Ki-Jang Han, Cheonan-si (KR); Min-Hyung No, Cheonan-si (KR)

(73) Assignees: KOREA INSTITUTE OF CIVIL ENGINEERING AND BUILDING TECHNOLOGY, Goyang-si (KR); KONGJU NATIONAL UNIVERSITY INDUSTRY-UNIVERSITY COOPERATION FOUNDATION, Gongju-si (KR)

( * ) Notice: Subject to any disclaimer, the term of this patent is extended or adjusted under 35 U.S.C. 154(b) by 0 days.

(21) Appl. No.: 16/716,145

(22) Filed: Dec. 16, 2019

(65) Prior Publication Data

US 2020/0190753 A1 Jun. 18, 2020

(30) Foreign Application Priority Data

Dec. 18, 2018 (KR) ..... 10-2018-0164454

(51) Int. Cl.
*E01F 15/14* (2006.01)
*E01F 9/631* (2016.01)
*E04H 12/22* (2006.01)

(52) U.S. Cl.
CPC ..... *E01F 9/644* (2016.02); *E01F 15/141* (2013.01); *E04H 12/2292* (2013.01)

(58) Field of Classification Search
CPC ..... E01F 15/148; E01F 9/644; E01F 9/631; E01F 15/141; E01F 15/00; E01F 15/003; E04H 12/2292
(Continued)

(56) References Cited

U.S. PATENT DOCUMENTS 4,452,431 A * 6/1984 Stephens ..... E01F 15/146 256/13.1
4,674,911 A * 6/1987 Gertz ..... F16F 9/049 256/13.1
(Continued)

FOREIGN PATENT DOCUMENTS

KR 20-0234520 Y1 9/2001
KR 10-0658568 B1 12/2006
(Continued)

*Primary Examiner* — Christopher Garft
*Assistant Examiner* — Michael McDuffie
(74) *Attorney, Agent, or Firm* — Goldilocks Zone IP Law

(57) ABSTRACT

Disclosed is a crashworthy post, which allows a post body to slide rearward along with a vehicle at the early stage of a vehicle collision, and simultaneously a compressive deforming pipe is compressed to dissipate impact energy.

3 Claims, 29 Drawing Sheets

(58) Field of Classification Search
USPC ..... 248/548, 519, 529, 530, 533, 156, 424, 248/429, 346.06; 256/13.1; 52/98, 296, 52/297, 831; 404/10
See application file for complete search history.

(56) References Cited

U.S. PATENT DOCUMENTS

| | | | | |
|---|---|---|---|---|
| 4,751,801 | A * | 6/1988 | Andersson | E01F 9/642 52/98 |
| 5,165,818 | A * | 11/1992 | Newhart | E01F 9/635 256/13.1 |
| 2001/0014254 | A1* | 8/2001 | Albritton | E01F 15/146 404/6 |
| 2003/0070894 | A1* | 4/2003 | Reid | E01F 15/143 188/377 |
| 2003/0165356 | A1* | 9/2003 | Breed | E01F 9/662 404/6 |
| 2004/0265055 | A1* | 12/2004 | Zivkovic | E01F 9/642 404/6 |
| 2006/0193688 | A1* | 8/2006 | Albritton | E01F 15/146 404/6 |
| 2006/0228165 | A1* | 10/2006 | Yonan | E01F 9/638 403/2 |
| 2008/0205982 | A1* | 8/2008 | Hubbell | E01F 15/146 404/6 |
| 2013/0008096 | A1* | 1/2013 | Griffiths | E01F 9/635 52/99 |
| 2013/0185971 | A1* | 7/2013 | Mandi | G09F 7/18 40/606.15 |
| 2013/0249470 | A1* | 9/2013 | Martin | B60L 11/182 320/107 |
| 2014/0270937 | A1* | 9/2014 | Kulkarni | E01F 15/083 404/6 |
| 2014/0339486 | A1* | 11/2014 | Sharp | E01F 15/0476 256/65.14 |
| 2014/0379223 | A1* | 12/2014 | Wolkenstein | B60R 19/34 701/45 |
| 2015/0121733 | A1* | 5/2015 | Oberkofler | E01F 9/65 40/607.06 |
| 2016/0024732 | A1* | 1/2016 | Impero | E01F 15/146 256/13.1 |
| 2016/0027351 | A1* | 1/2016 | Cunha | F16L 3/26 248/49 |
| 2016/0032544 | A1* | 2/2016 | Landes | E01F 9/629 404/10 |
| 2017/0073996 | A1* | 3/2017 | Russo | E04H 17/143 |
| 2017/0074015 | A1* | 3/2017 | Batchelor | E06B 11/04 |
| 2017/0234393 | A1* | 8/2017 | Degroot | B62D 21/152 256/13.1 |

FOREIGN PATENT DOCUMENTS

| | | | |
|---|---|---|---|
| KR | 10-2007-0051801 | A | 5/2007 |
| KR | 10-2010-0103276 | A | 9/2010 |
| KR | 10-2010-0132428 | A | 12/2010 |
| KR | 10-1546524 | B1 | 8/2015 |
| KR | 10-2017-0077752 | A | 7/2017 |
| KR | 10-1800416 | B1 | 11/2017 |
| KR | 10-1868552 | B1 | 6/2018 |
| KR | 101868552 | B1 * | 6/2018 |

* cited by examiner

ENERGY ABSORBING POST HAVING SLIDING RAIL ASSEMBLY

CROSS-REFERENCE TO RELATED APPLICATION

This application claims priority to Korean Patent Application No. 10-2018-0164454, filed on Dec. 18, 2018, and all the benefits accruing therefrom under 35 U.S.C. § 119, the contents of which in its entirety are herein incorporated by reference.

BACKGROUND

1. Field

The present disclosure relates to a crashworthy post capable of reducing collision energy generated when a vehicle makes a collision.

2. Description of the Related Art

A crashworthy post for a telegraph pole, a light pole, a road sign or the like includes a vertical body and a collision energy absorbing member. If a vehicle collides with the crashworthy post, the body moves to transfer the force to the collision energy absorbing member. Accordingly, the collision energy absorbing member is compressively deformed or crushed to dissipate the collision energy of the vehicle. In the crashworthy post, it is very important that the body moves while decelerating slowly. As the body decelerates rapidly, the impact force applied to an occupant of the colliding vehicle increases proportionately. Thus, it is necessary to design the colliding vehicle and the body such that the colliding vehicle does not rapidly decelerate while the collision energy is being dissipated by the collision energy absorbing member, in order to protect the occupant more safely.

Conventionally, rubber or synthetic resin is used for the collision energy absorbing member. However, after the body crushes or compressively deforms the collision energy absorbing member, the body decelerates rapidly or decelerates at an irregular rate due to residues of the deformed or crushed collision energy absorbing member. Due to this phenomenon, a significant impact force may be applied to the occupant of the colliding vehicle.

SUMMARY

The present disclosure is designed to solve the problems of the conventional art, and the present disclosure is directed to preventing a body of a crashworthy post or a colliding vehicle from rapidly decelerating due to residues of a collision energy absorbing member, after the collision energy absorbing member is compressively deformed or crushed. In particular, the present disclosure is directed to protecting an occupant of the vehicle more safely by designing the body to decelerate at a predetermined rate to prevent a great impact from being applied to the occupant when the vehicle makes a collision.

In order to accomplish the above object, the present disclosure provides a crashworthy post, which includes a base member having a sliding rail assembly embedded therein, a post body installed to the base member, and a base plate provided to a lower end of the post body.

In the present disclosure, the compressive deforming pipe performs excellently as a collision energy absorbing member. Thus, the impact applied to an occupant is reduced when a vehicle makes a collision, thereby ensuring the occupant safety. In particular, in the present disclosure, the compressive deforming pipe is compressively deformed not rapidly but gradually. Thus, it is possible to prevent the collision energy from being rapidly dissipated, thereby preventing the body and the colliding vehicle from rapidly decelerating.

In particular, in the present disclosure, the compressive deforming pipe is prevented from being rapidly crushed or from being compressively deformed only in the longitudinal direction. In addition, the compressive deforming pipe is not crushed or deformed to form fragments. Thus, the movement of the body is not disturbed due to residues such as fragments of the compressive deforming pipe, thereby preventing the moving body from being rapidly or irregularly decelerated. That is, in the present disclosure, after the collision of the vehicle, the body moves to be slowly decelerated at a uniform rate, and thus the vehicle may be safely stopped without applying a large impact to the occupant of the colliding vehicle.

In addition, in the present disclosure, only a deformed portion of the compressive deforming pipe may be replaced with a new one, and thus the crashworthy post may be restored to be reused quickly and easily. Thus, even after a vehicle makes a collision accident, it is possible to quickly reinstall the crashworthy post, thereby maintaining a safe road environment.

DETAILED DESCRIPTION

Figure 1:
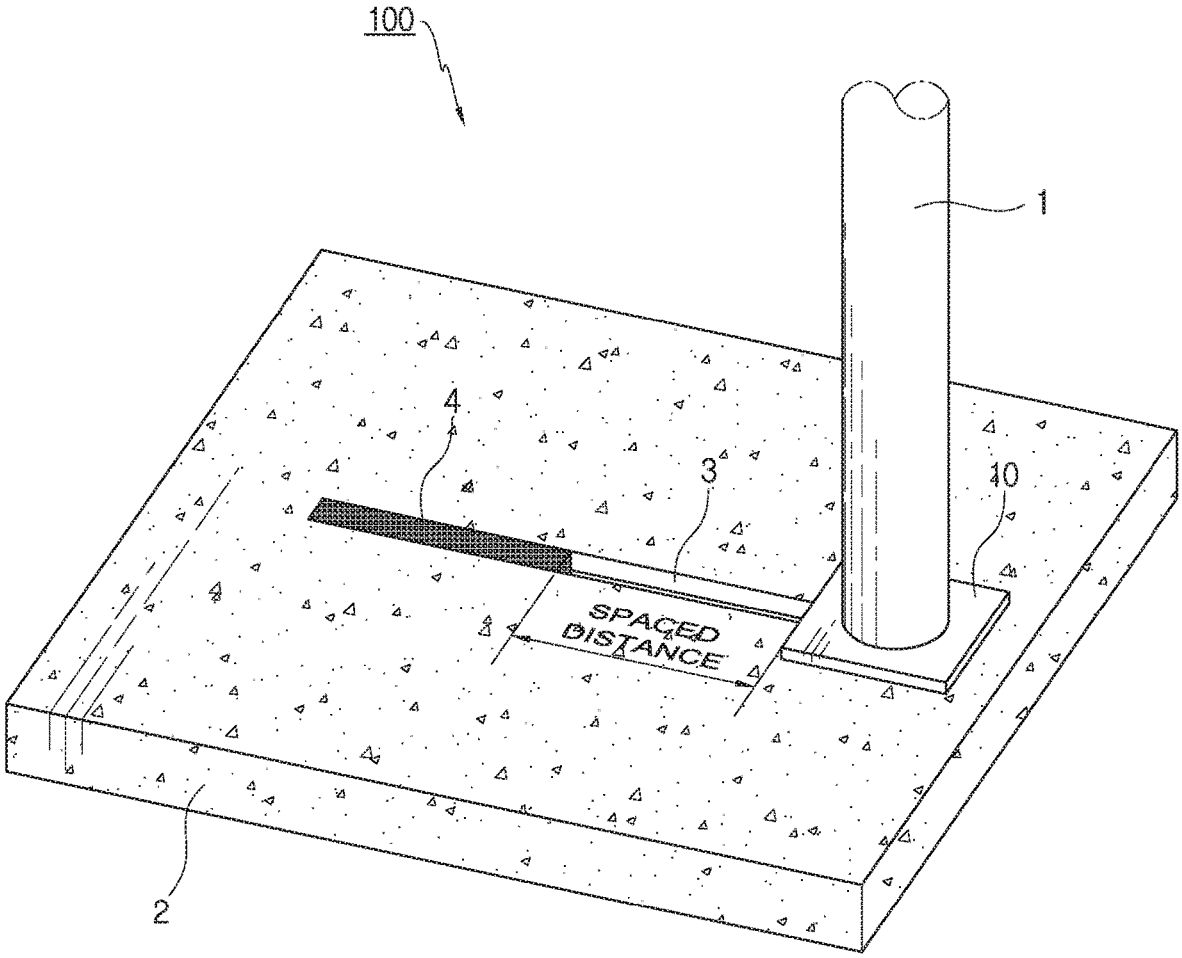
FIG. 1 is a schematic perspective view showing a conventional crashworthy post.

Hereinafter, a preferred embodiment of the present disclosure will be described with reference to the accompanying drawings. Although the present disclosure is described with reference to the embodiment shown in the drawings, this is just an example, and the technical idea of the present disclosure and its essential configuration and operation are not limited thereto. In this specification, the term "rearward" refers to a direction in which a vehicle collides toward a post body, namely a direction in which the vehicle moves to approach the post. That is, in FIG. 2, the direction indicated by the arrow K is the "rearward" direction. Thus, in this specification, the term "forward" refers to a direction facing the vehicle from the post body when the vehicle collides toward the post body, namely a direction opposite to the rearward direction. In addition, the term "longitudinal direction" refers to a direction connecting by the forward direction and the rearward direction, and the term "lateral direction" refers to a direction orthogonal to the longitudinal direction on the plane.

Figure 2:
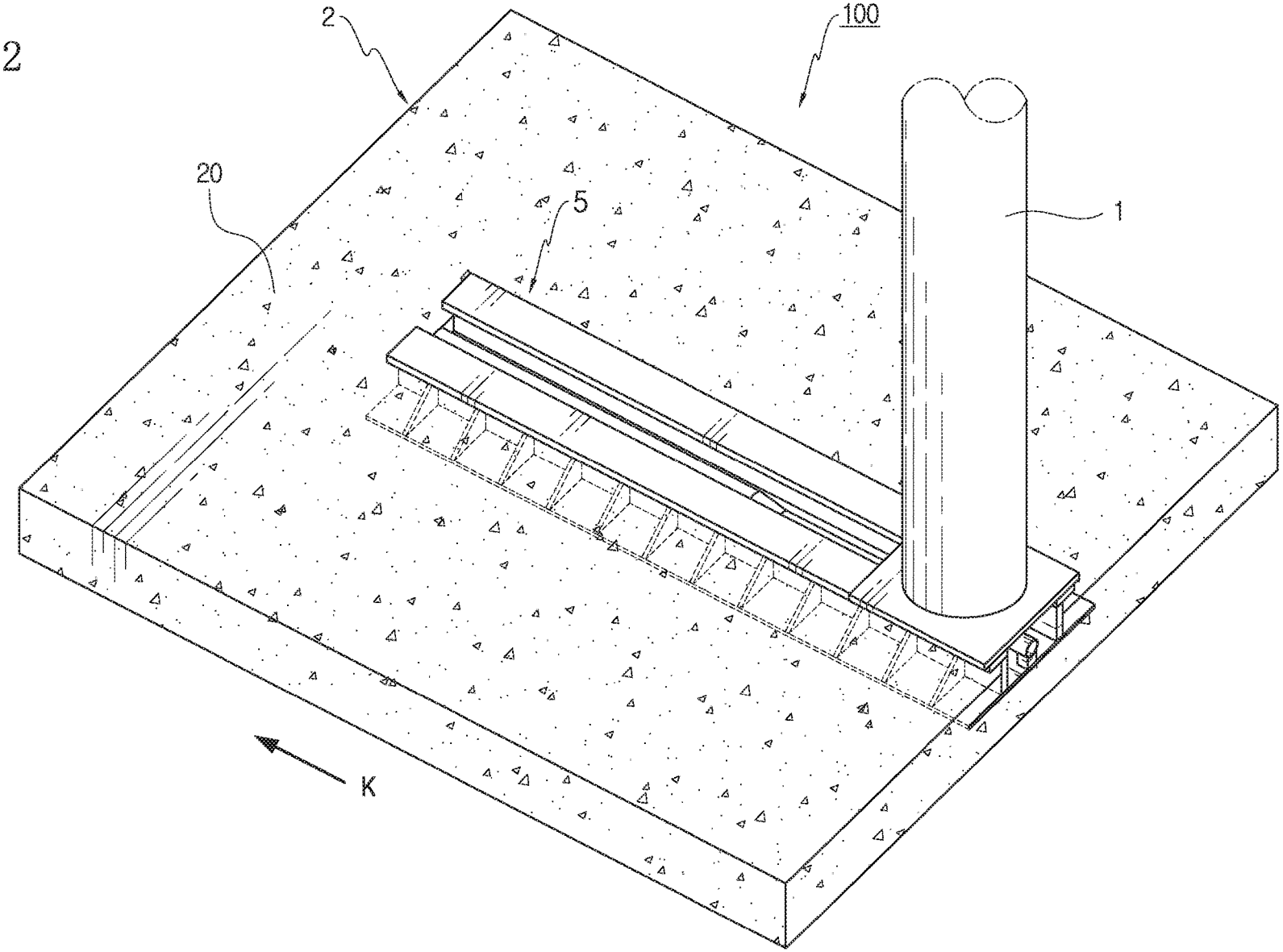
FIG. 2 is a schematic perspective view showing an assembled crashworthy post according to the first embodiment of the present disclosure in an assembled state.

FIG. 2 is a schematic perspective view showing a crashworthy post 100 according to the first embodiment of the present disclosure. The crashworthy post 100 includes a base member 2 and a post body 1. The body 1 stands up vertically on the base member 2 to be capable of sliding rearward.

The base member 2 includes a sliding rail assembly 5 and a concrete member 20. The sliding rail assembly 5 is integrated with the concrete member. The concrete member 20 may have a slab. The concrete member 20 may be a cast-in-place concrete structure, but may also be a precast structure.

Figure 3:
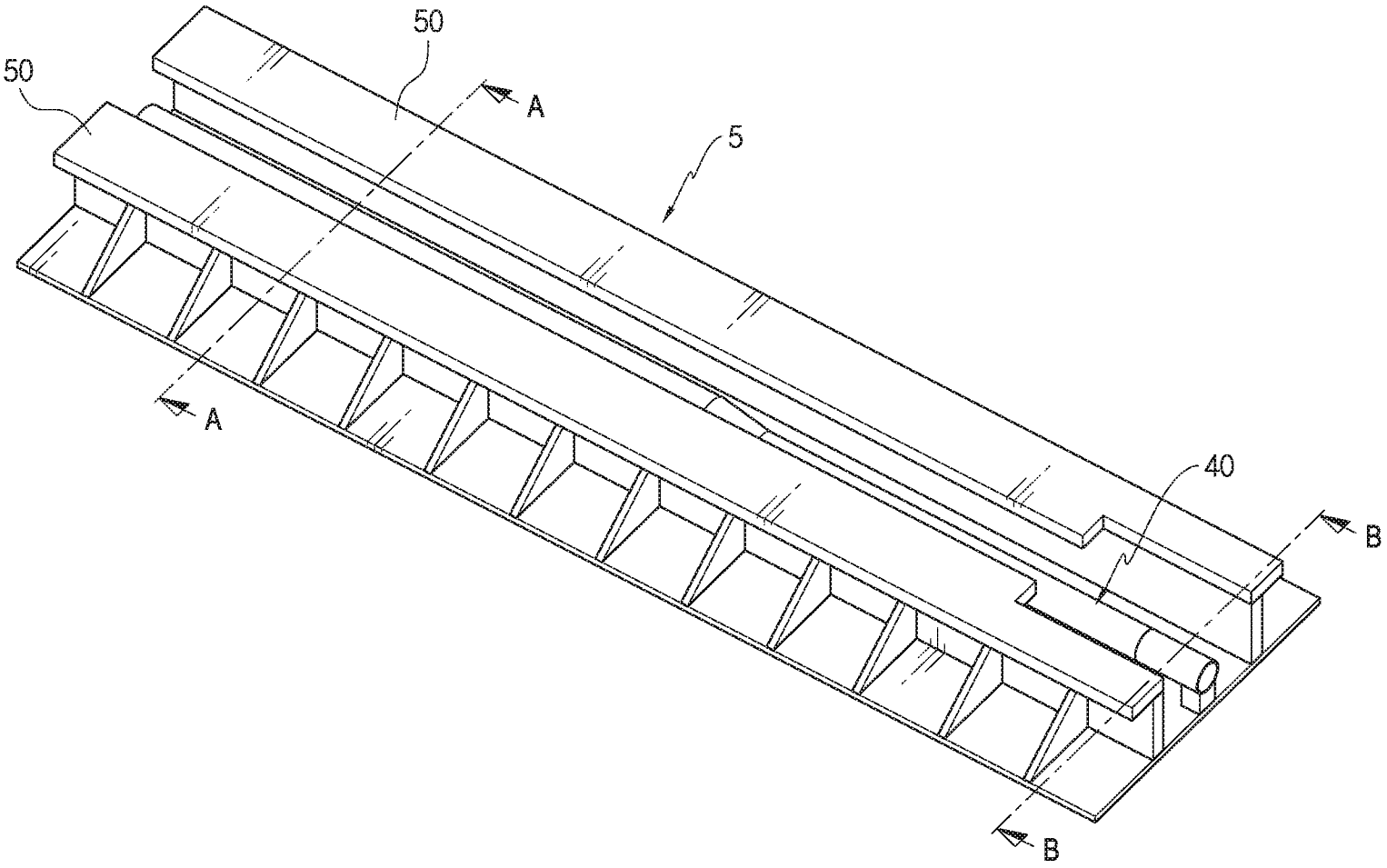
FIG. 3 is a schematic perspective view showing a sliding rail assembly provided in the first embodiment of the present disclosure.
Figure 4:
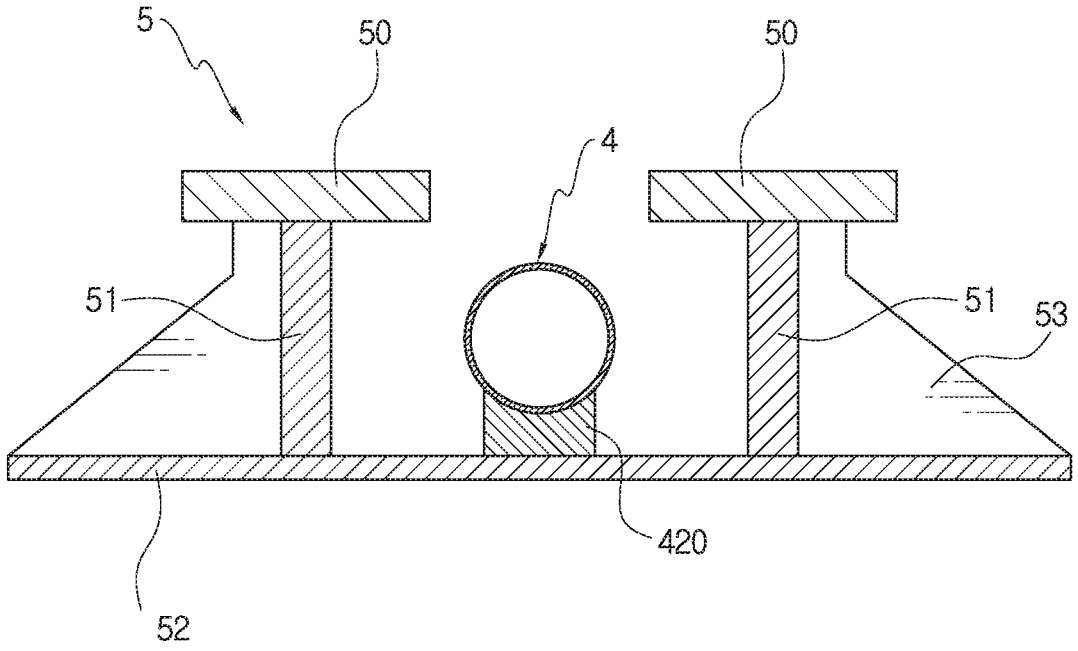
FIG. 4 is a schematic rear sectioned view showing the sliding rail assembly, taken along the arrow A-A of FIG. 3.
Figure 5:
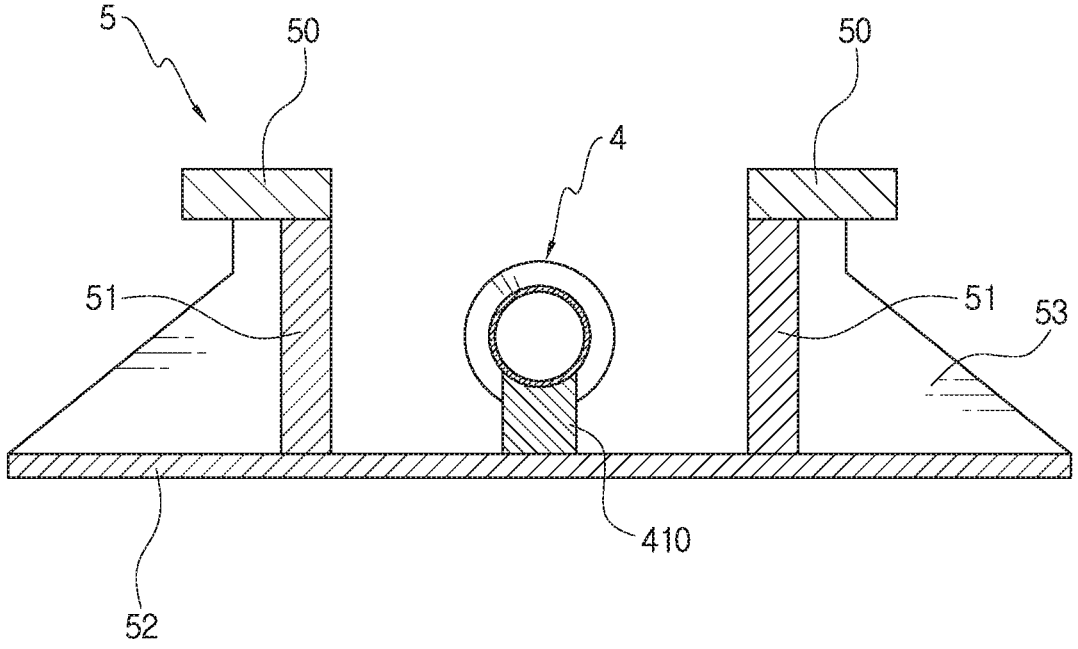
FIG. 5 is a schematic rear sectioned view showing the sliding rail assembly, taken along the arrow B-B of FIG. 3.
Figure 6:
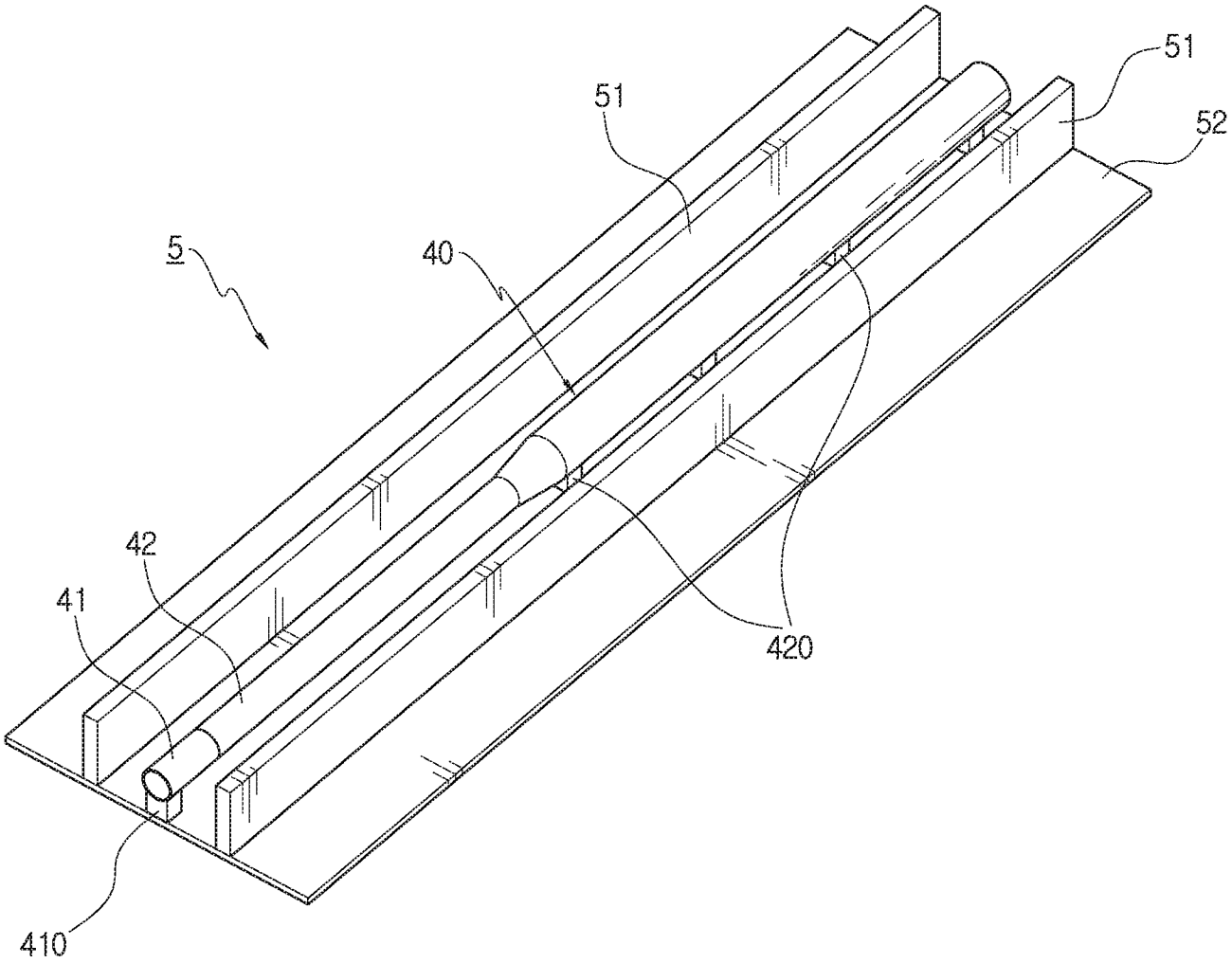
FIG. 6 is a schematic perspective view showing the sliding rail assembly of FIG. 3, from which a sliding support member is excluded to depict a compressive deforming pipe.

FIG. 3 shows the sliding rail assembly 5 of FIG. 2 in a state of being not embedded in the concrete member 20 of the base member 2. FIG. 4 is a schematic sectioned view showing a rear side of the sliding rail assembly 5, taken along the arrow A-A of FIG. 3. FIG. 5 is a schematic sectioned view showing the rear side of the sliding rail assembly 5, taken along the arrow B-B of FIG. 3. In FIG. 6, the sliding support member 50 is not depicted to show a compressive deforming pipe 40 provided to the sliding rail assembly 5.

The sliding rail assembly 5 includes a sliding support member 50, a vertical support member 51, and a bottom member 52. The sliding support member 50 is made of a pair of members arranged in parallel on the same plane with a lateral interval and elongated in the longitudinal direction. The sliding support member 50 may be made of a flat plate. The sliding support member 50 supports the base plate 10 provided at the lower end of the post body 1. The sliding support member 50 functions as a sliding rail which allows the base plate 10 to slide rearward.

In the first embodiment of FIGS. 2 to 5, a widening cut portion is formed at the sliding support member 50. The pair of sliding support members 50 are cut to a predetermined width in a predetermined length region in the longitudinal direction from the forward end of the sliding rail assembly 5. By doing so, the widening cut portion having a larger lateral interval between the sliding support members 50 than that of the other regions is formed in the predetermined length region. Through the widening cut portion, a pressing member 11 may be easily positioned between the vertical support members 51 by vertically moving downward. However, the widening cut portion is an optional configuration.

The vertical support member 51 is a member that supports the sliding support member 50 to be positioned at a vertical distance from the bottom member 52. The vertical support member 51 is elongated in the longitudinal direction and is provided in a pair so that the pair of vertical support members 51 are provided vertically with a lateral interval. The pair of vertical support members 51 are integrally installed to the upper surface of the bottom member 52 to stand up vertically. The two vertical support members 51 support two sliding support members 50, respectively, and for this, the upper end of the vertical support member 51 is integrally coupled with the lower surface of the sliding support member 50. In the first embodiment illustrated in the figures, the lateral interval between the two vertical support members 51 is greater than the lateral interval between the two sliding support members 50. Each vertical support member 51 may be made of a plate member. The space between the two vertical support members 51 corresponds to a guide trough 3.

The bottom member 52 is coupled to the lower end of the vertical support member 51 and may be made of a flat plate. If necessary, a reinforcing rib 53 may be provided between the bottom member 52 and the outer surface of the vertical support member 51. A compressive deforming pipe 40 corresponding to a collision energy absorbing member is located at the guide trough 3.

Figure 7:
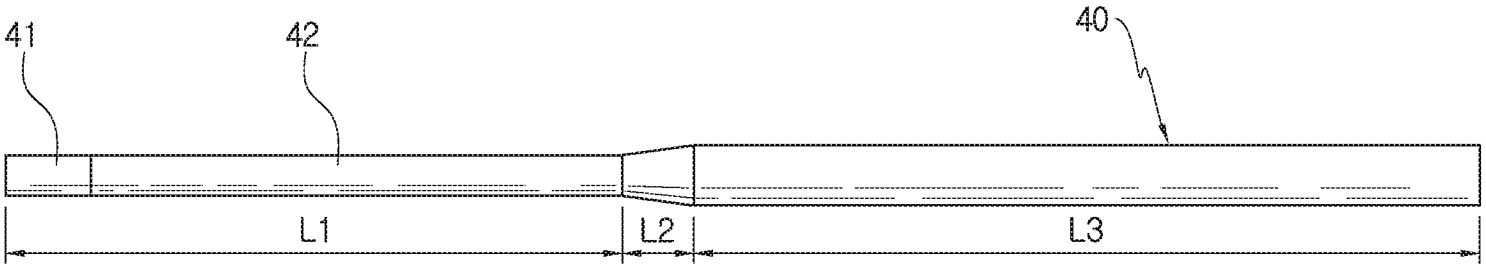
FIG. 7 is a schematic side view showing an example of the compressive deforming pipe provided in the present disclosure.

FIG. 7 is a schematic side view showing an example of the compressive deforming pipe 40 provided in the present disclosure. The compressive deforming pipe 40 is a tubular member which is elongated in the longitudinal direction and has a hollow, and may be made of, for example, steel. In a state where the pressing member 11 surrounds the outer circumference of the compressive deforming pipe 40, the pressing member 11 moves rearward to press the compressing compressive deforming pipe 40 so that the compressing compressive deforming pipe 40 is deformed. The collision energy is dissipated by the compressive deformation of the compressive deforming pipe 40. In order to more efficiently dissipate the collision energy, in the present disclosure, the compressive deforming pipe 40 may be configured such that its sectional diameter gradually changes from the front to the rear. That is, the compressive deforming pipe 40 has a larger sectional diameter in the rear portion thereof than the front portion. As the pressing member 11 surrounding the outer circumference of the front portion of the compressive deforming pipe 40 moves rearward, the sectional size of the compressive deforming pipe 40 decreases to dissipate the collision energy.

The compressive deforming pipe 40 according to the embodiment illustrated in FIG. 7 is classified into a spaced distance forming region L1 having a small diameter, a diameter changing region L2 changing from a small diameter to a large diameter, and a compressive deforming region L3 having a large diameter, from the front to the rear in the longitudinal direction. In the diameter changing region L2, the outer surface of the compressive deforming pipe 40 is inclined. In the compressive deforming pipe 40 according to the embodiment illustrated in the figures, the compressive deforming region L3 has a constant sectional diameter as a whole. However, if necessary, the compressive deforming region L3 may be made to have a sectional diameter gradually increasing rearward. In the compressive deforming pipe 40 of FIG. 7, the spaced distance forming region L1 also has a constant sectional diameter as a whole. However, the spaced distance forming region L1 may also have a sectional diameter gradually increasing rearward, except for a region where the pressing member 11 is installed first.

The compressive deforming pipe 40 is disposed at the guide trough 3 formed by the space between the two vertical support members 51. The compressive deforming pipe 40 should be spaced apart from the bottom of the guide trough. In order to dissipate the vehicle collision energy, the compressive deforming pipe 40 should be disposed not to move in the longitudinal direction. The compressive deforming pipe 40 may be arranged in the form of a cantilever whose front and rear ends are fixed and whose remaining part is spaced apart from the bottom.

For this, in the first embodiment of the present disclosure, the spaced distance forming region L1 (a region corresponding to the spaced distance in FIG. 1) of the compressive deforming pipe 40 is divided into a front fixing end 41 and a continuous portion 42 continuously assembled to the front fixing end 41. That is, in the present disclosure, the spaced distance forming region L1 of the compressive deforming pipe 40 may be divided into the front fixing end 41 corresponding to the foremost portion of the compressive deforming pipe 40 and the continuous portion 42 continuously assembled thereto. In order to prevent the compressive deforming pipe 40 from moving in the longitudinal direction, in the first embodiment of the present disclosure, the front fixing end 41 is coupled with a fixing part 410, the fixing part 410 is integrally coupled with the sliding rail assembly (specifically, the bottom member), and the continuous portion 42 is securely assembled to the front fixing end 41. Through this configuration, the compressive deforming pipe 40 is disposed in the form of a cantilever at the guide trough 3 in a state where the front fixing end 41 is fixed by the fixing part 410 and elongated in the rearward direction. If necessary, a spacer 420 may be installed to the upper surface of the bottom member 52 inside the guide trough 3 so that the compressive deforming pipe 40 is placed in the spacer 420.

In the first embodiment of the present disclosure, the front end of the compressive deforming pipe 40 is fixed by the fixing part 410, and the other portion of the compressive deforming pipe 40 is positioned to be suspended in the air inside the guide trough 3. When the outer surface of the compressive deforming pipe 40 is pressed and compressively deformed by the pressing member 11, the compressive deforming pipe 40 itself is prevented from moving in the longitudinal direction, and it is naturally allowed that the compressive deforming pipe 40 expands in the longitudinal direction.

Figure 8:
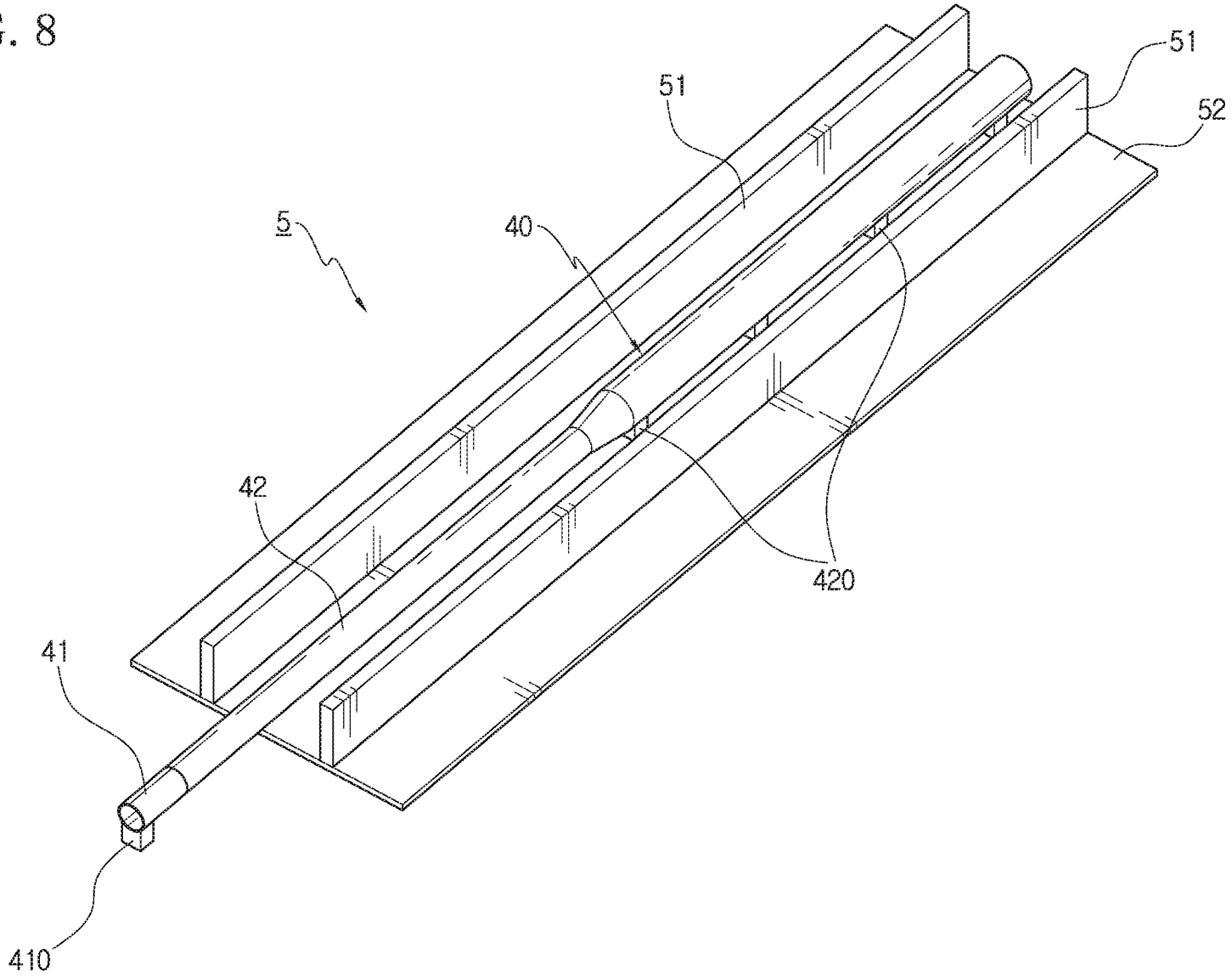
FIGS. 8 and 9 are schematic perspective views corresponding to FIG. 6, respectively showing the sliding rail assembly at which the compressive deforming pipe installed thereto is modified.

FIG. 8 is a schematic perspective view corresponding to FIG. 6, showing the sliding rail assembly 5, where the installation configuration of the compressive deforming pipe 40 is modified. In FIG. 8, the spaced distance forming region L1 of the compressive deforming pipe 40 is divided into a front fixing end 41 and a continuous portion 42. The front fixing end 41 is coupled to the fixing part 410. The length of the compressive deforming pipe 40 is longer than the bottom member 52, and the fixing part 410 is fixed to the ground at a front position of the bottom member 52. Though not shown in the figures, when fixing the front fixing end 41 of the compressive deforming pipe 40, the fixing part 410 may not be installed to the ground or the bottom member 52 but be installed between the sliding support member 50 and the front fixing end 41 or between the vertical support member 51 and the front fixing end 41.

Figure 9:
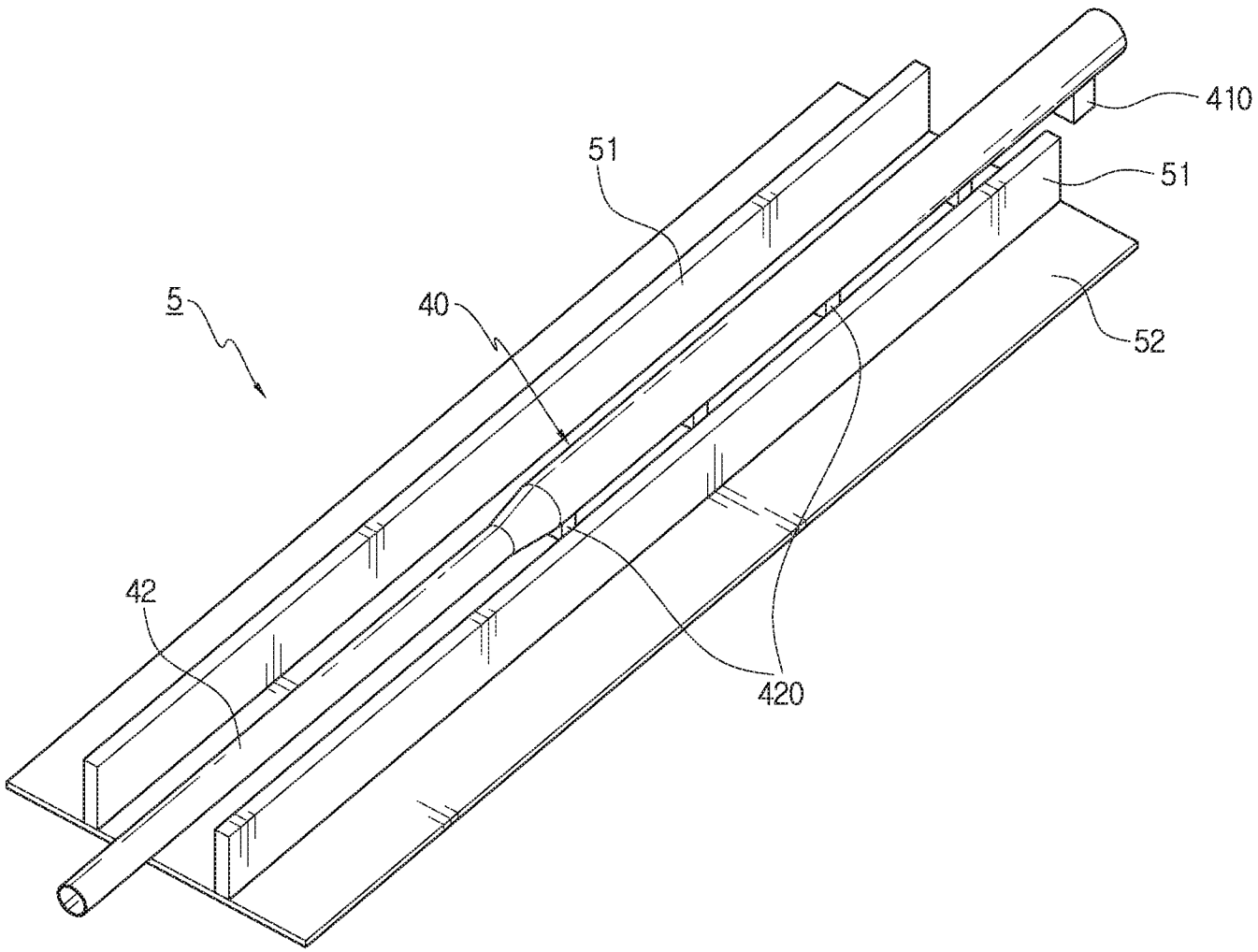

The fixing part 410 may be coupled to the rear end of the compressive deforming pipe 40. FIG. 9 is a schematic perspective view corresponding to FIG. 6, showing the sliding rail assembly 5 where the installation configuration of the compressive deforming pipe 40 is modified. As shown in FIG. 9, the fixing part 410 is coupled to the rear end of the compressive deforming pipe 40. The fixing part 410 is fixed to the ground or the bottom member 52. By doing this, the compressive deforming pipe 40 may be disposed at the guide trough 3 in the form of a cantilever having a fixed rear end. In this case, it is not necessary to divide the spaced distance forming region L1 of the compressive deforming pipe 40 into the front fixing end 41 and the continuous portion 42.

Figure 10:
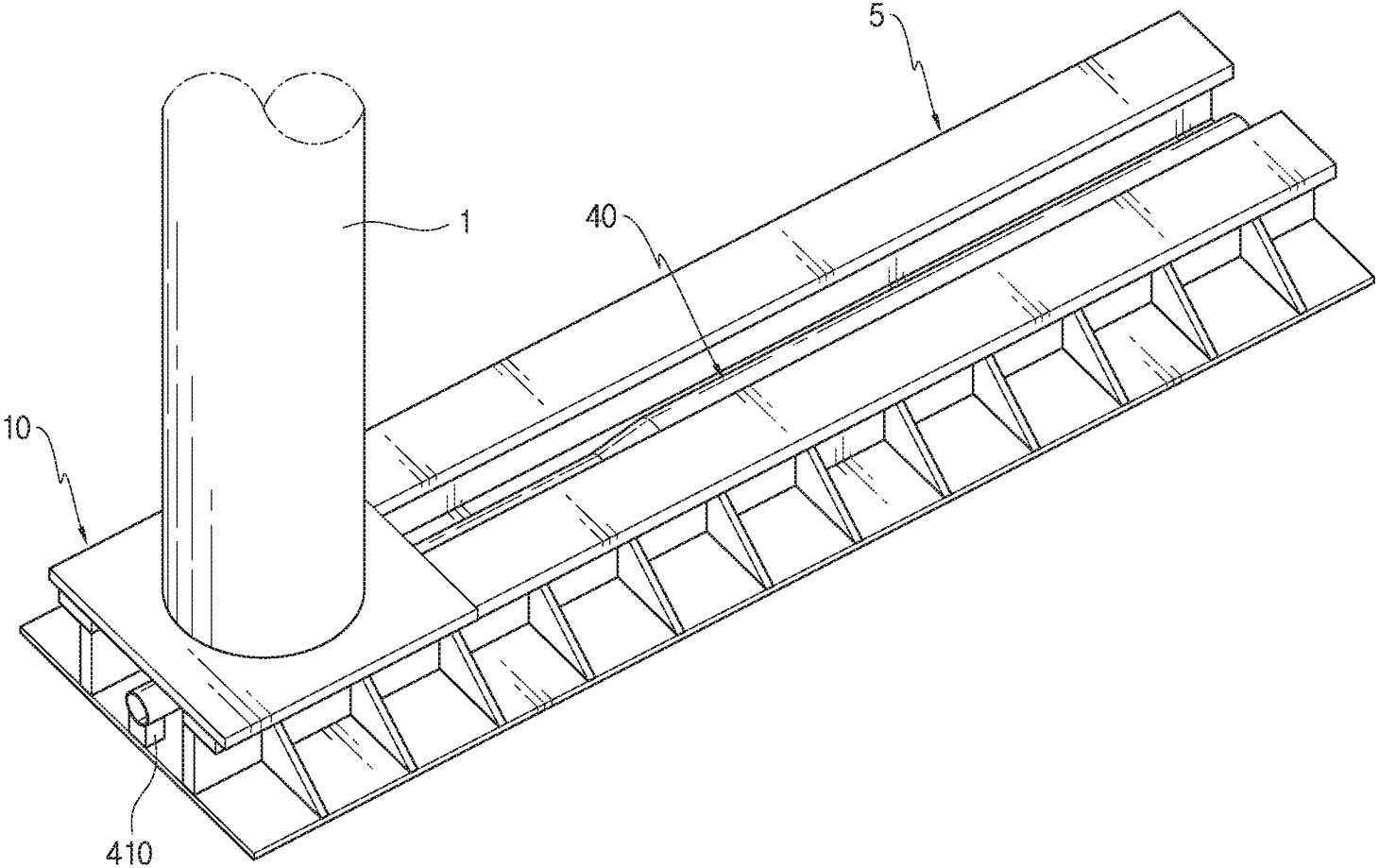
FIG. 10 is a schematic perspective view showing a base plate of the crashworthy post, which is assembled to the sliding rail assembly of FIG. 3.
Figure 11:
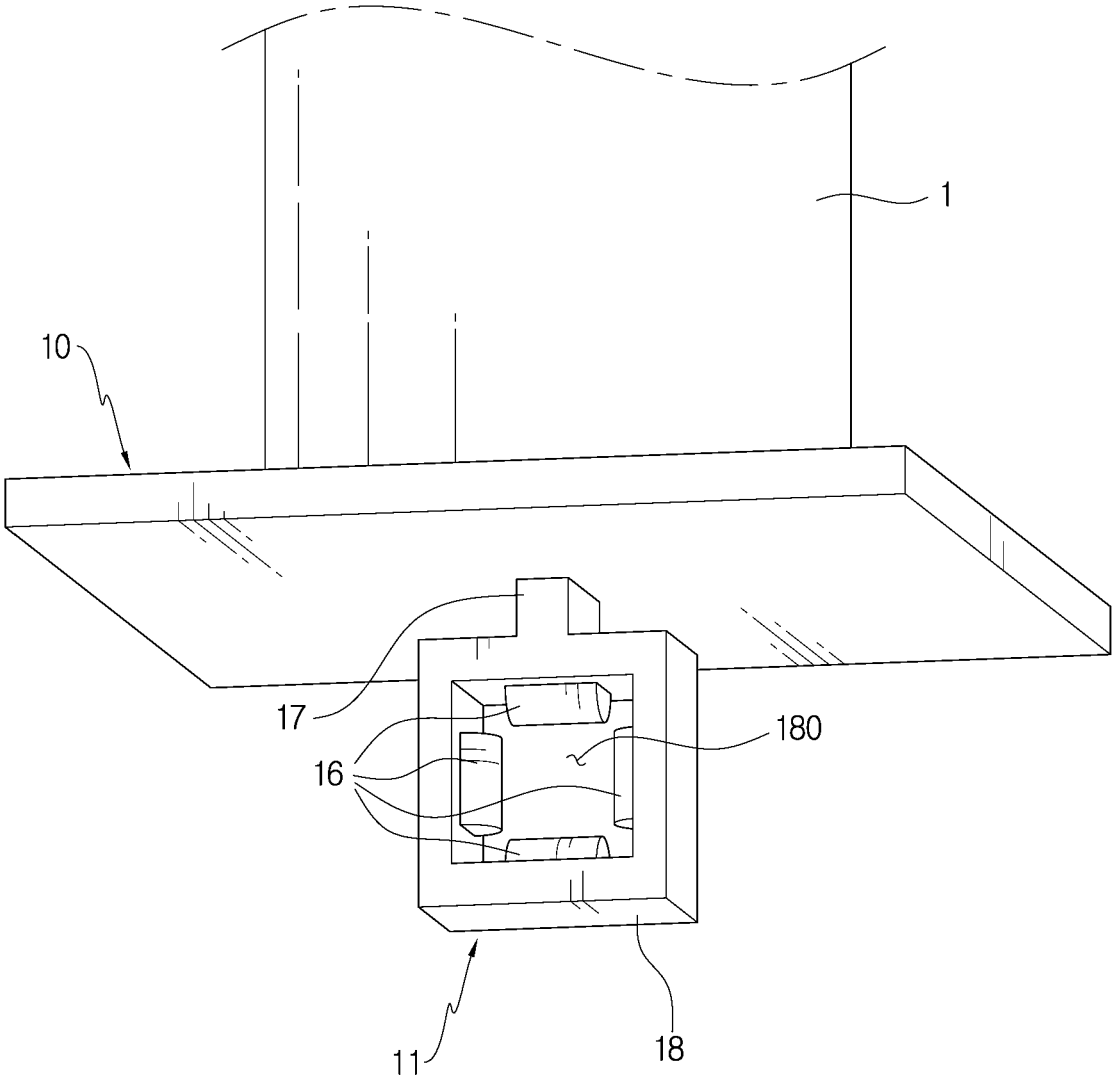
FIGS. 11 and 12 are schematic perspective views showing only the post body and the base plate according to the first embodiment of the present disclosure in different viewpoints.
Figure 12:
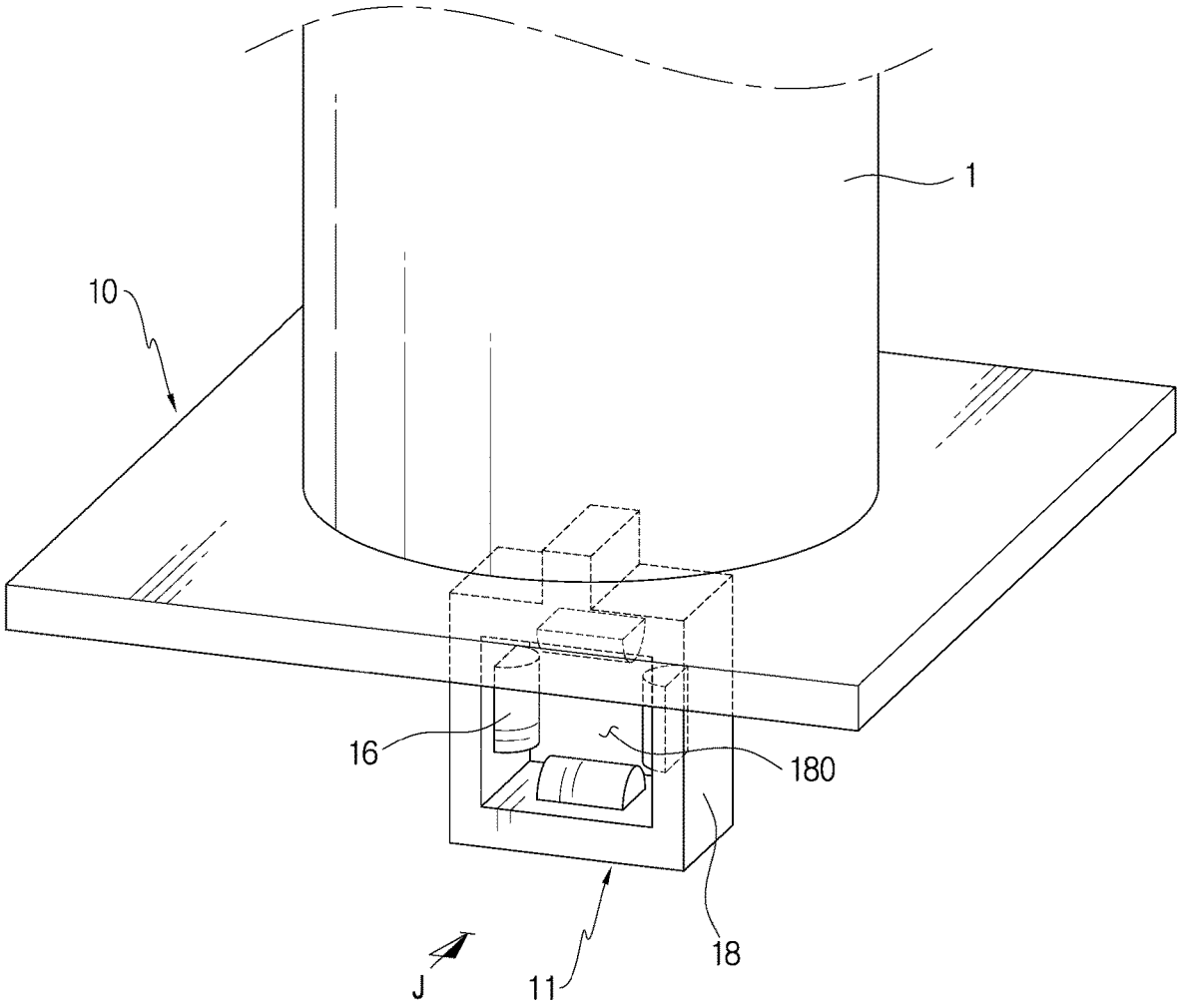
Figure 13:
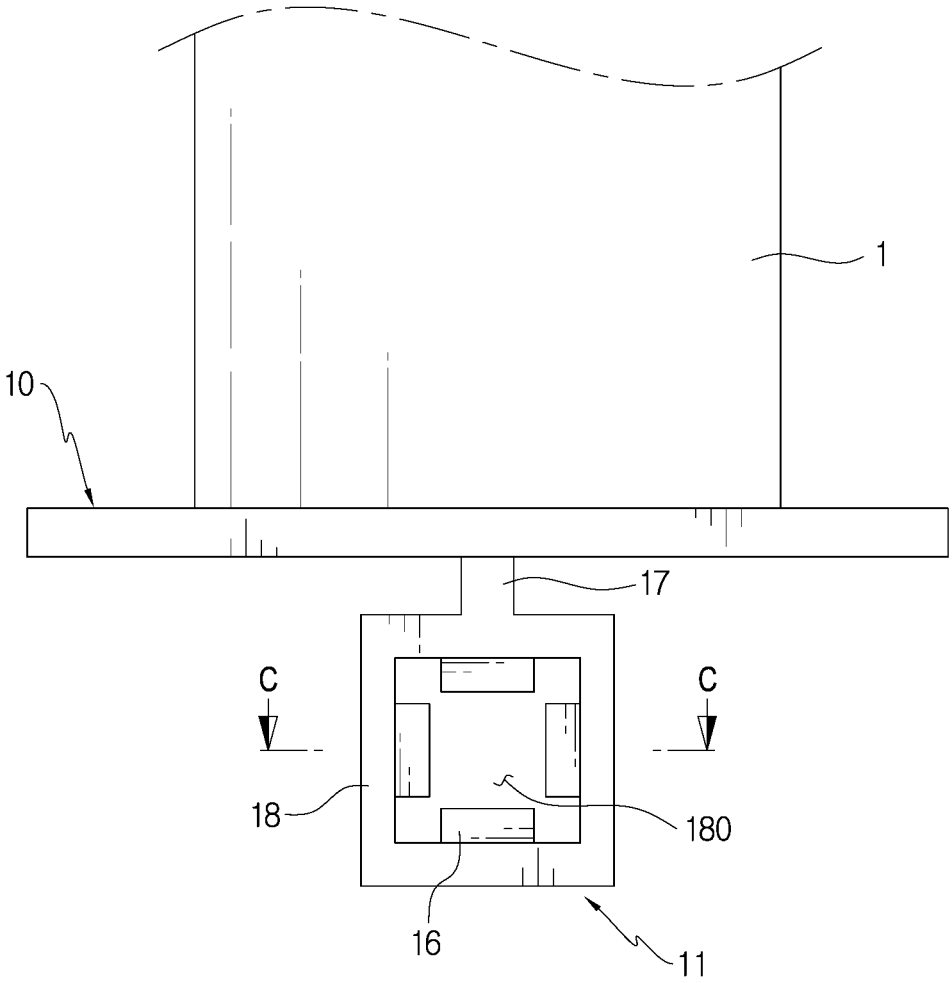
FIGS. 13 and 14 are a schematic front view showing the post body and the base plate of FIG. 11 along the arrow J of FIG. 12 and a schematic planar sectioned view along the arrow C-C.
Figure 14:
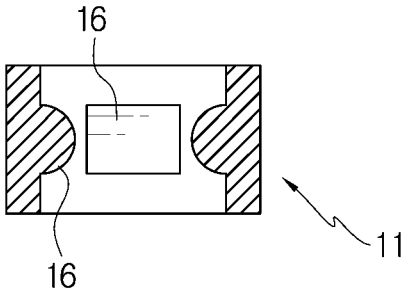

FIG. 10 shows a state where the post body 1 of the crashworthy post and the base plate 10 provided at the lower end thereof are assembled to the sliding rail assembly 5 of FIG. 3 according to the first embodiment of the present disclosure. FIGS. 11 and 12 show the post body 1 and the base plate 10 according to the first embodiment of the present disclosure, respectively. FIG. 13 is a schematic front view showing the post body 1 and the base plate 10 along the arrow J of FIG. 12. FIG. 14 is a schematic planar sectioned view showing the pressing member 11 along the arrow C-C of FIG. 13.

The post body 1 is a pillar-shaped member to which a road sign or the like is installed. The base plate 10 is integrally provided to the lower end of the post body 1. The base plate 10 is a plate member and is disposed such that the lower surface of the base plate 10 comes into close contact with the upper surface of the sliding support member 50. Thus, the post body 1 is installed to the sliding support member 50 to vertically stand up. The pressing member 11 is integrally provided to the lower surface of the base plate 10. The pressing member 11 surrounds the outer circumference of the compressive deforming pipe 40. While the post body 1 and the base plate 10 are moving rearward due to the collision of the vehicle, the pressing member 11 presses and deforms the compressive deforming pipe 40. The pressing member 11 includes an outer frame member 18 having a perforated portion 180 formed at the center thereof to surround the outer circumference of the compressive deforming pipe 40. A close pressing member 16 is provided to the inner surface of the perforated portion 180 of the outer frame member 18 to make close contact with the outer circumference of the compressive deforming pipe 40 and press and deform the compressive deforming pipe 40. The close pressing member 16 may have a semicircular pillar shape. The close pressing member 16 is installed such that a convex curved portion of the semicircular pillar faces the center of the perforated portion 180. The close pressing member 16 is provided in plurality.

In the first embodiment of the present disclosure, the pressing member 11 is connected to the base plate 10 by a hanger member 17. Thus, the pressing member 11 is integrally provided to be suspended downward from the lower surface of the base plate 10. The hanger member 17 is located in the interval between the pair of sliding support members 50. When the post body 1 moves rearward, the hanger member 17 moves rearward by passing through the interval between the pair of sliding support members 50. However, hanger member 17 is optional. The outer frame member 18 may also be coupled in direct contact with the lower surface of the base plate 10.

Figure 15:
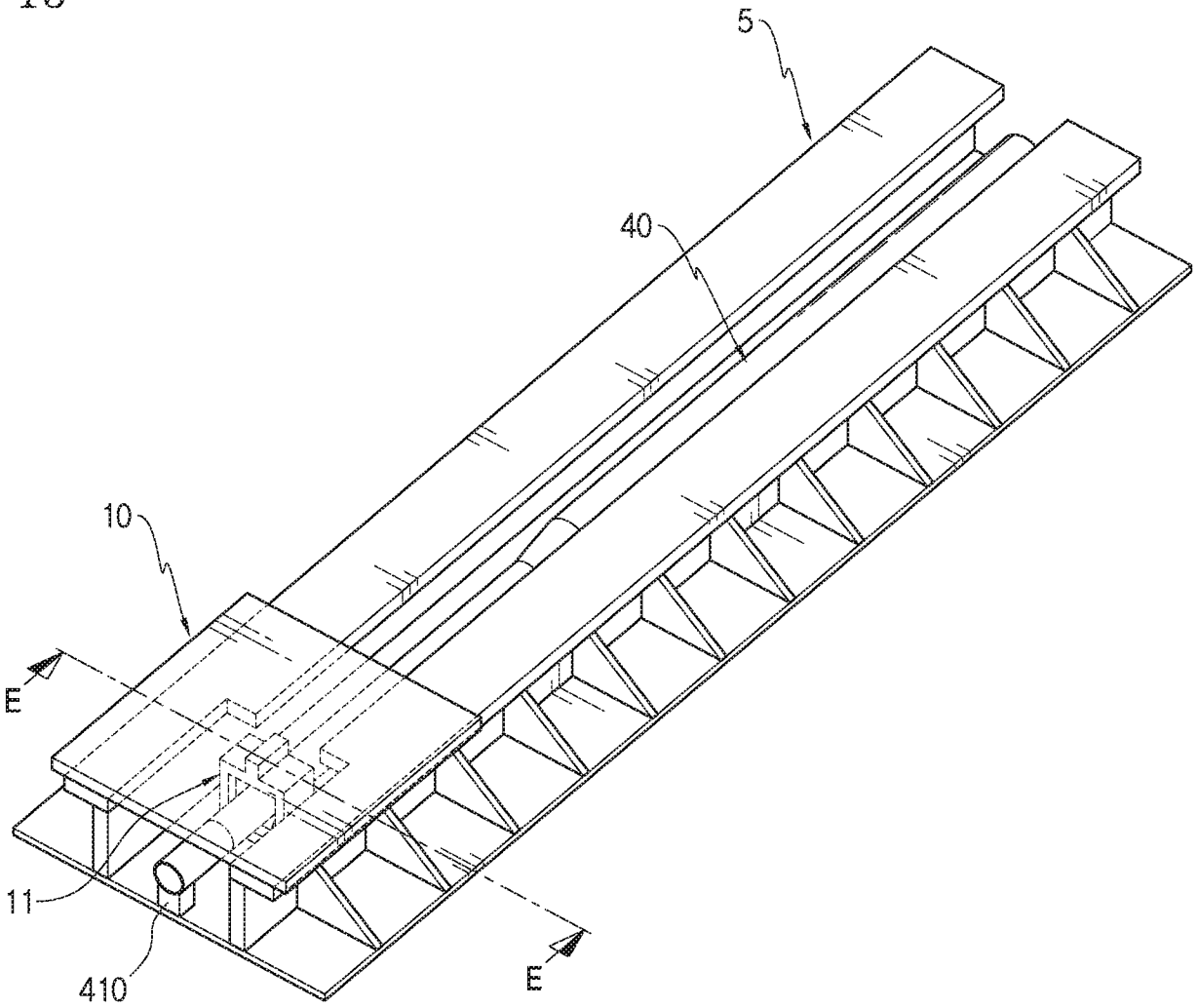
FIG. 15 is a schematic perspective view showing the base plate according to the first embodiment of the present disclosure, which is assembled to the sliding rail assembly of FIG. 3.
Figure 16:
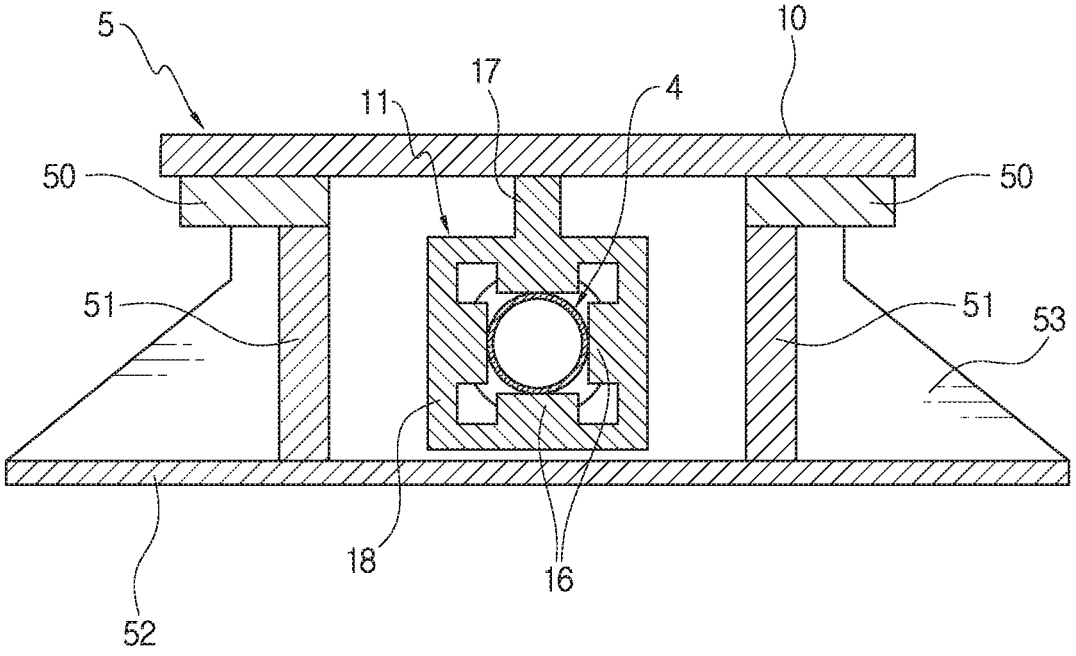
FIG. 16 is a schematic longitudinal sectioned view, taken along the arrow E-E of FIG. 15.
Figure 19:
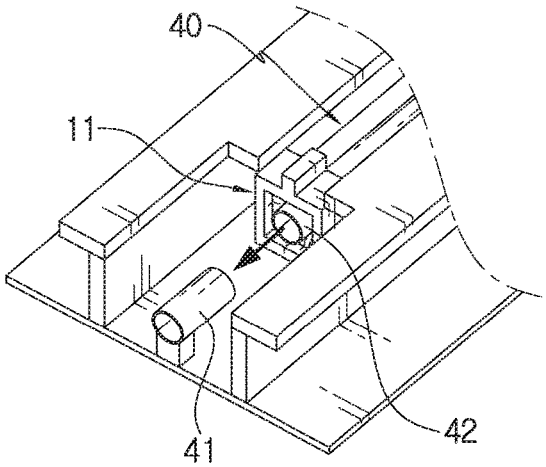
Figure 20:
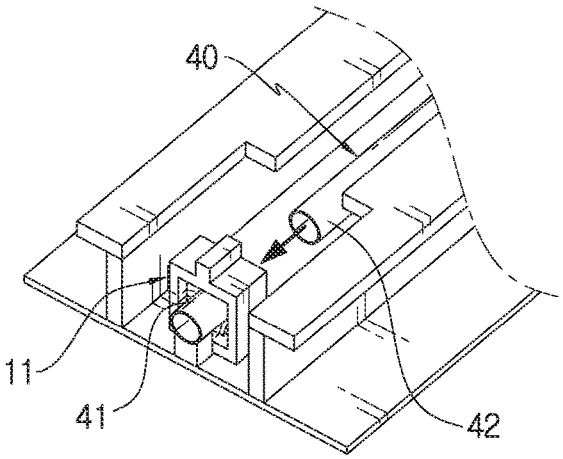
Figure 21:
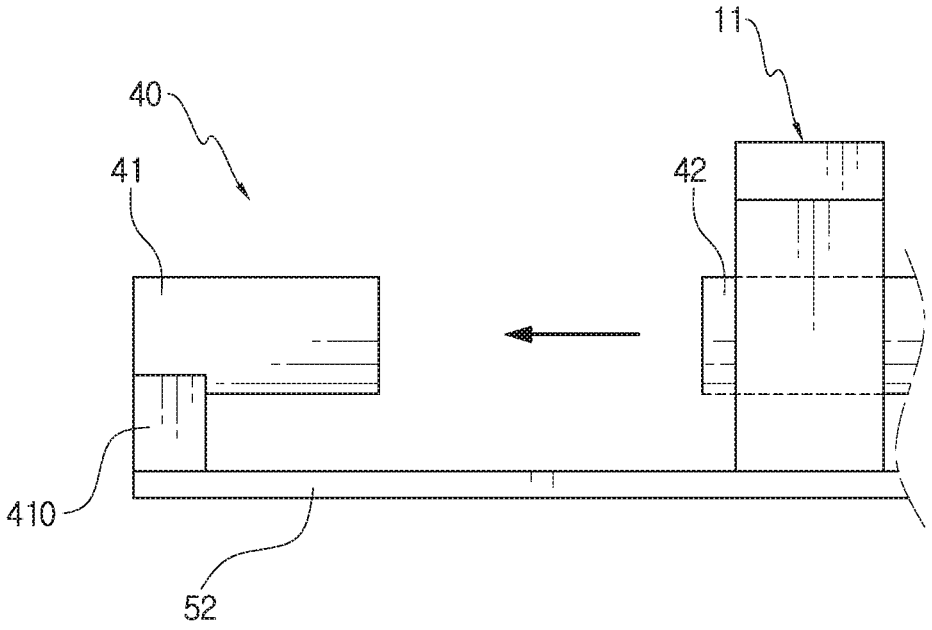
FIGS. 21 and 22 are schematic side views showing the states of FIGS. 19 and 20, respectively.
Figure 22:
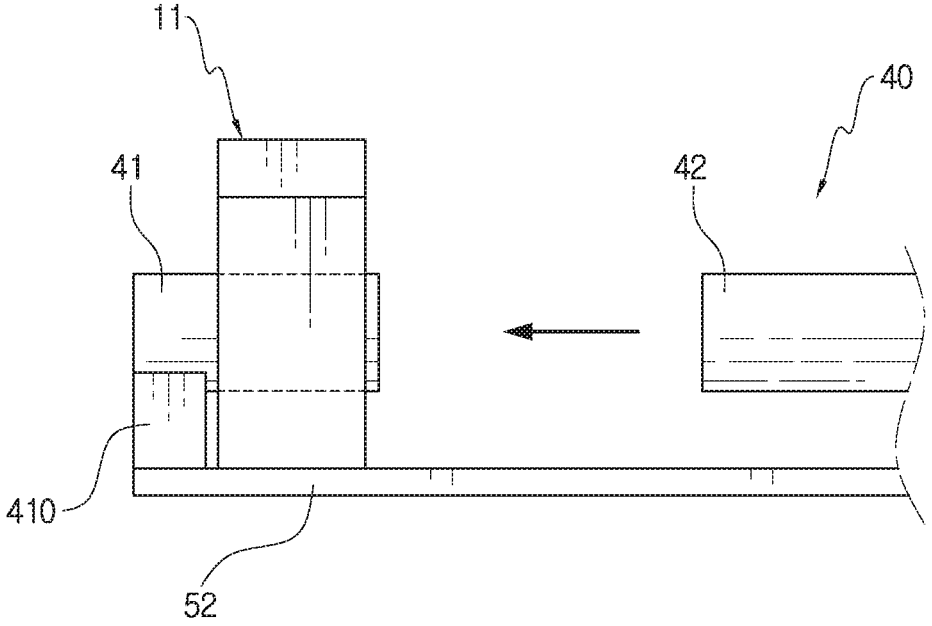

FIG. 15 is a schematic perspective view showing a state where the base plate 10 is assembled to the sliding rail assembly 5 of FIG. 3 according to the first embodiment of the present disclosure. FIG. 16 is a schematic longitudinal sectioned view along the arrow E-E of FIG. 15. FIGS. 17, 18, 19 and 20 are schematic perspective views for sequentially illustrating a process of assembling the pressing member 11 to the compressive deforming pipe 40. FIGS. 21 and 22 are schematic side views showing the states of FIGS. 19 and 20 in a lateral form, respectively. In FIGS. 15 and 16, the post body 1 is not depicted for convenience, and in FIGS. 16, 17, 18, 19, 20, 21 and 22, the post body 1 and the base plate 10 are also not depicted for convenience.

Figure 17:
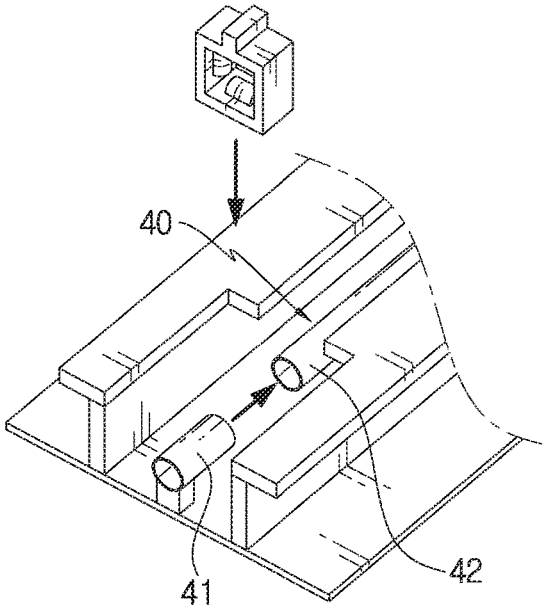
FIGS. 17, 18, 19, and 20 are schematic perspectives view showing for sequentially illustrating a process of assembling each pressing member to the compressive deforming pipe, respectively.

The base plate 10 is coupled to the lower end of the post body 1. The pressing member 11 is coupled to the lower surface of the base plate 10. The outer frame member 18 surrounds the outer circumference of the compressive deforming pipe 40, and simultaneously the base plate 10 is placed on the upper surface of the sliding support member 50. In the first embodiment of the present disclosure, as shown in FIG. 17, the spaced distance forming region L1 of the compressive deforming pipe 40 is divided into the front fixing end 41 and the continuous portion 42. At the position where the widening cut portion of the sliding support member 50 is formed, if the base plate 10 is placed on the upper surface of the sliding support member 50, the pressing member 11 vertically passes downward through the widening cut portion and is positioned between the two vertical support members 51. In the first embodiment of the present disclosure, since the widening cut portion is formed at the sliding support member 50, the pressing member 11 may be very easily positioned in the space between the vertical support members 51 by simply placing the base plate 10 on the sliding support member 50.

Figure 18:
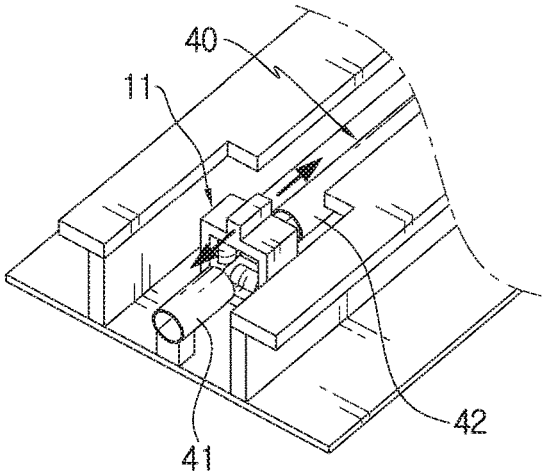

Next, as shown in FIG. 18, the pressing member 11 is moved forward or rearward in the longitudinal direction. Accordingly, the front fixing end 41 or the continuous portion 42 is interposed in the perforated portion 180 of the outer frame member 18. As shown in FIGS. 19 and 21, the pressing member 11 is moved rearward in the longitudinal direction so that the continuous portion 42 is interposed in the perforated portion 180 of the outer frame member 18, whereby the outer frame member 18 surrounds the outer circumference of the continuous portion 42. As an alternative, as shown in FIGS. 20 and 22, the pressing member 11 may be moved forward in the longitudinal direction so that the front fixing end 41 penetrate the perforated portion 180 of the outer frame member 18, whereby the outer frame member 18 surrounds the outer circumference of the front fixing end 41. Next, the front fixing end 41 and the continuous portion 42 are assembled again and firmly integrated so as to be continuous with each other as shown in FIG. 15. Through the above process, the outer frame member 18 of the pressing member 11 is installed to surround the outer circumference of the compressive deforming pipe 40 in the spaced distance forming region L1 of the compressive deforming pipe 40.

In the first embodiment of the present disclosure, as described above, the base plate 10 and the sliding rail assembly 5 may be assembled in a state where the sliding rail assembly 5 is installed to the base member 2. That is, after the base member 2 is made such that the sliding rail assembly 5 is embedded in and integrated with the concrete member 20, the post body 1 including the base plate 10 and the pressing member 11 may be assembled to the sliding rail assembly 5. By doing so, it is possible to further enhance the convenience of work.

Figure 23:
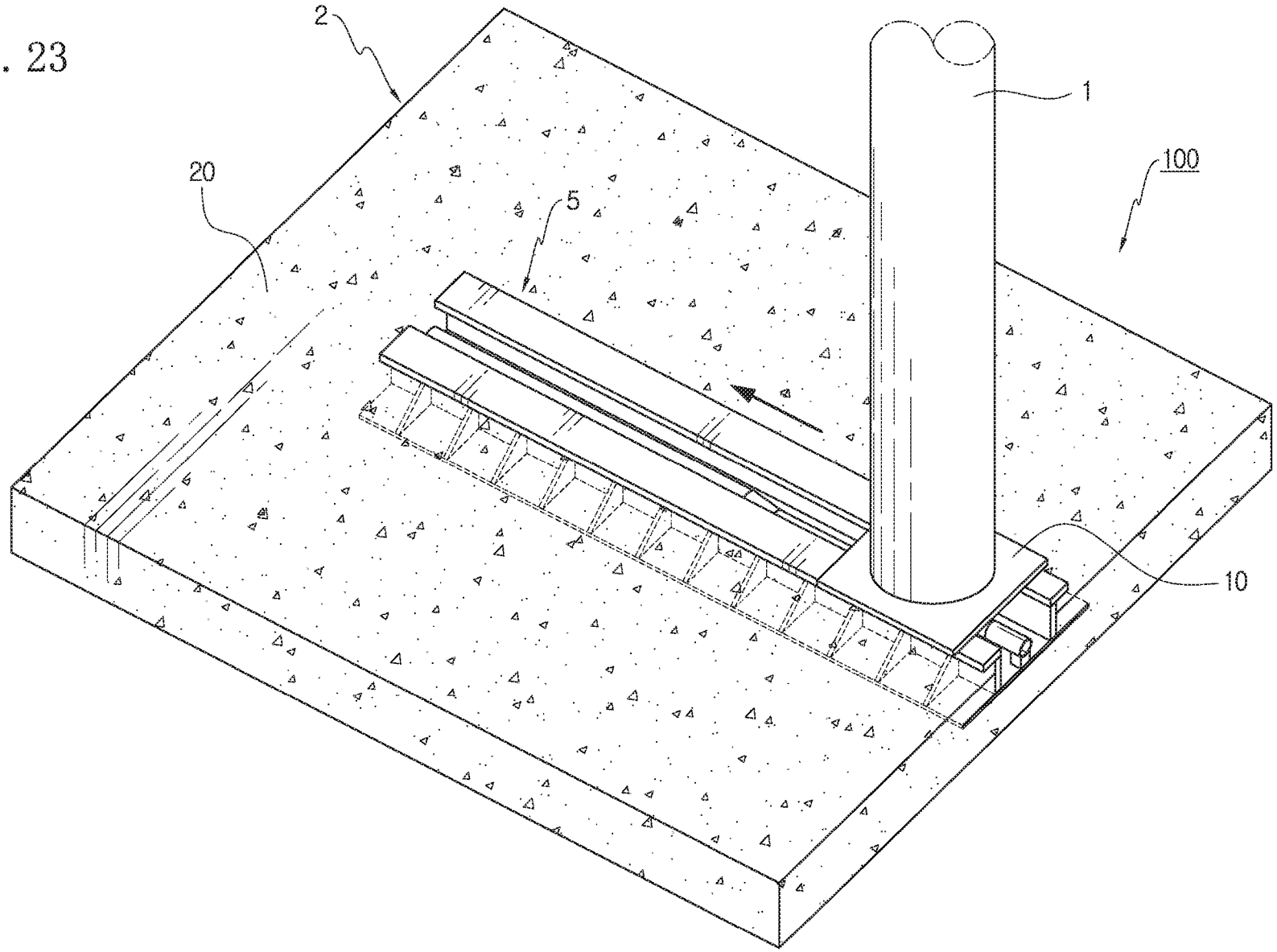
FIG. 23 is a schematic perspective view showing a finally installed state of the crashworthy post according to the first embodiment of the present disclosure.
Figure 24:
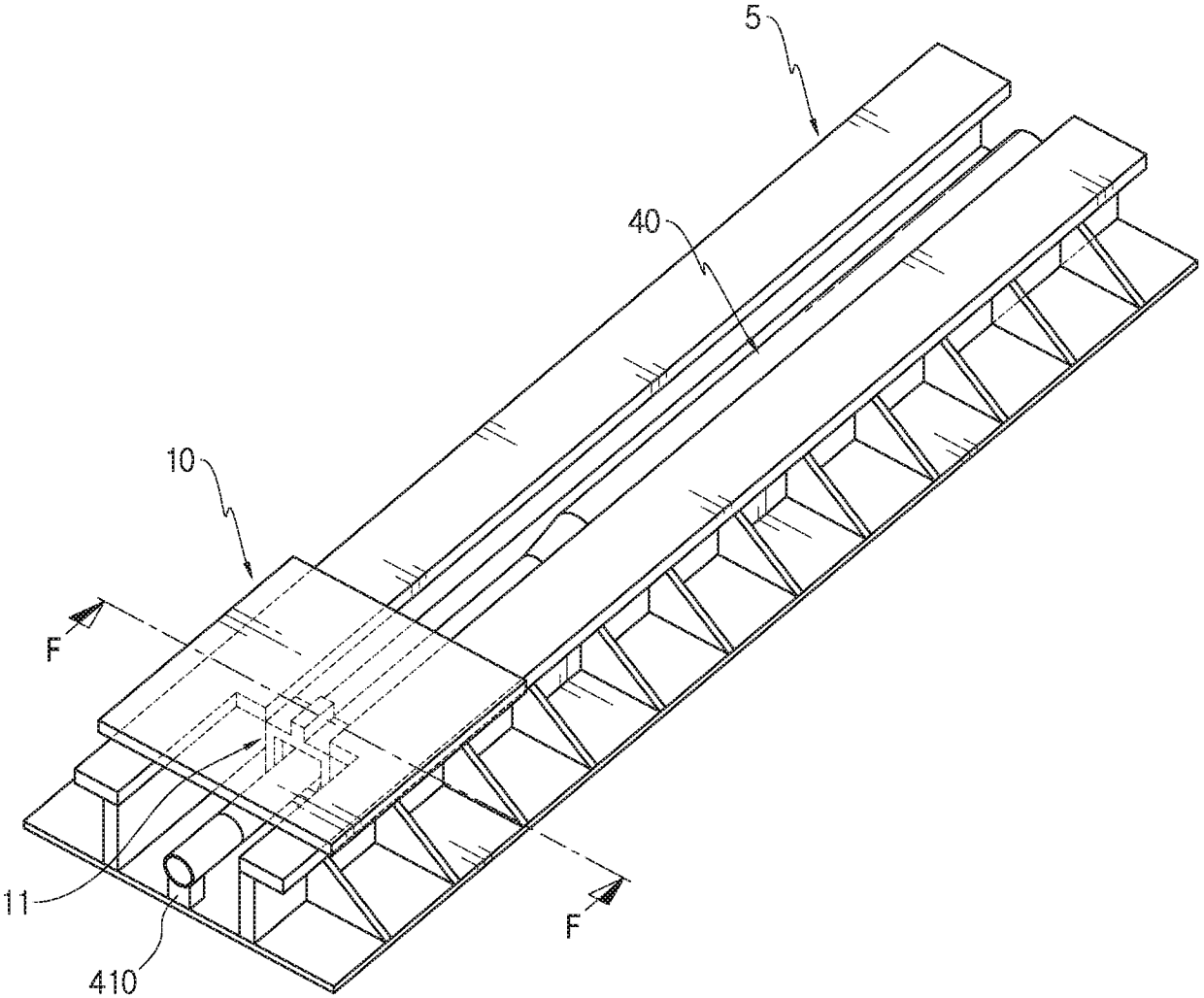
FIG. 24 is a schematic perspective view showing only the sliding rail assembly, the base plate and the compressive deforming pipe from FIG. 23.
Figure 25:
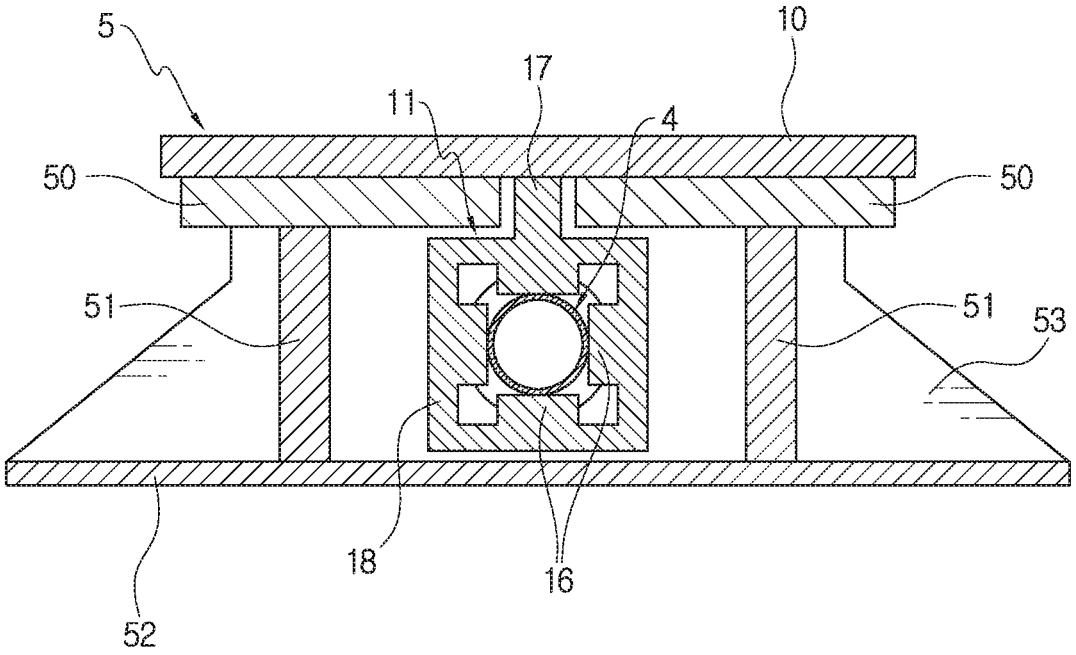
FIG. 25 is a schematic longitudinal sectioned view, taken along the arrow F-F of FIG. 24.

After the pressing member 11 is installed to surround the outer circumference of the compressive deforming pipe 40, it is desirable to move the pressing member 11 rearward in the longitudinal direction so that the pressing member 11 deviates from a position where the widening cut portion of the sliding support member 50 is formed. FIG. 23 is a schematic perspective view showing a state where the post body 1 is completely installed to the sliding rail assembly 5 provided to the base member 2 according to the first embodiment of the present disclosure. FIG. 24 is a schematic perspective view showing only the sliding rail assembly 5, the base plate 10 and the compressive deforming pipe 40 of FIG. 23, except for the base member 2 and the post body 1. FIG. 25 is a schematic longitudinal direction sectioned view along the arrow F-F of FIG. 24.

As shown in FIGS. 18 to 20, at a position where the pressing member 11 does not have the widening cut portion, the lateral interval between the sliding support members 50 is smaller than the lateral width of the outer frame member 18. Thus, if the pressing member 11 is at the position without the widening cut portion, the sliding support member 50 is present above the outer frame member 18 of the pressing member 11. In other words, the pressing member 11 is positioned below the pair of sliding support members 50. Thus, the post body 1 may be prevented from being pulled up while the pressing member 11 is moving rearward. Thus, in a state where the hanger member 17 is interposed in the interval between the base plates 10 or while the hanger member 17 is moving rearward, even if a pull force to pull the post body 1 vertically upward is applied due to a wind load or the like, the pressing member 11 is blocked by the sliding support member 50 so that it is not pulled upward but maintains a very stable state.

Figure 26:
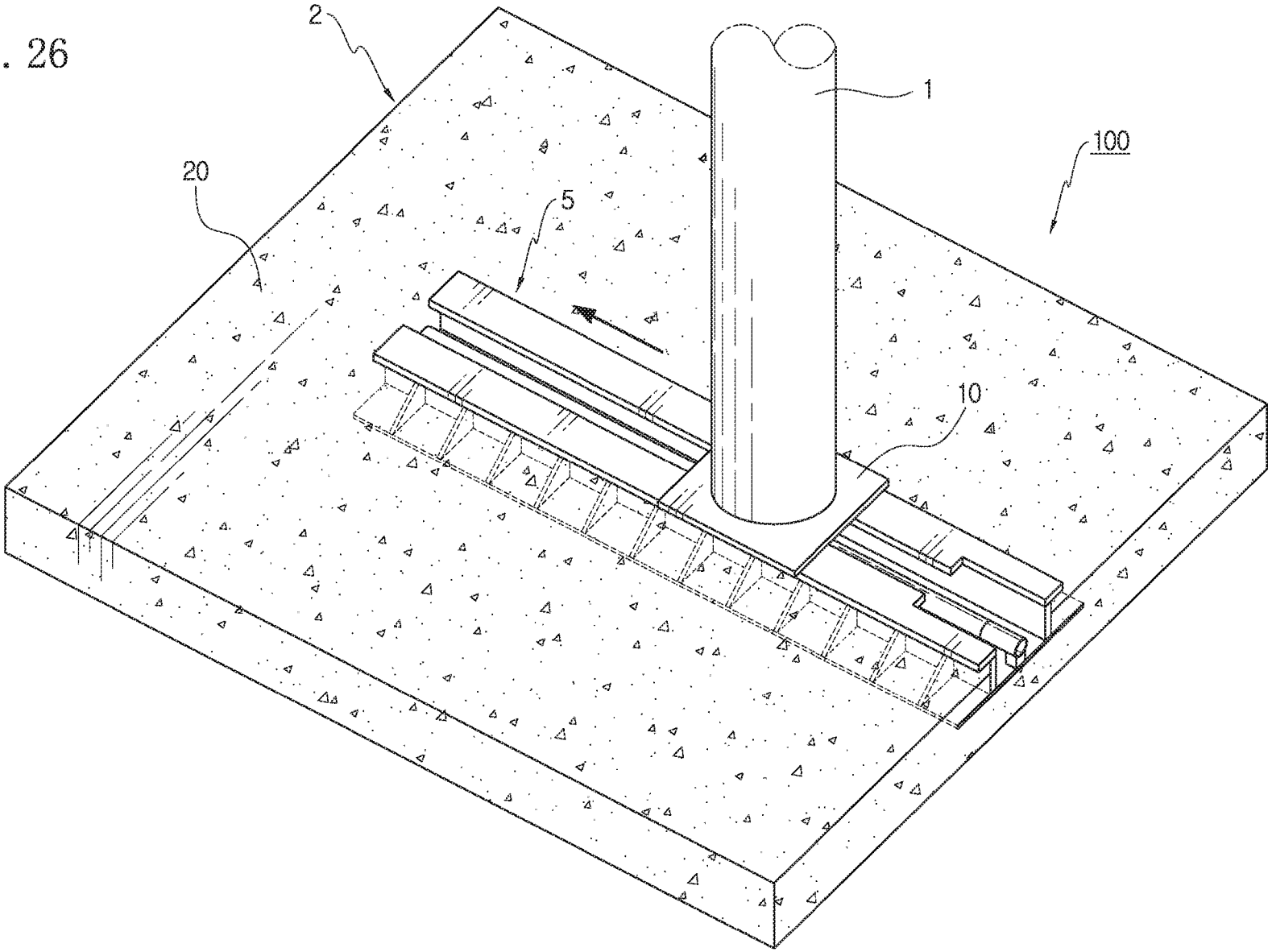
FIG. 26 is a schematic perspective view corresponding to FIG. 23, showing a state where the post body according to the first embodiment of the present disclosure is moved rearward over a spaced distance.

In a state where the crashworthy post 100 is completely installed by assembling the base member 2 and the post body 1, if the vehicle collides with the post body 1 of the crashworthy post 100, the vehicle, the post body 1 and the base plate 10 begin to move rearward. FIG. 26 is a schematic perspective view showing a state where the post body 1 moves rearward over the spaced distance, in the crashworthy post 100 according to the first embodiment of the present disclosure. Since the sliding support member 50 of the sliding rail assembly 5 is elongated rearward, the base plate 10 is pushed rearward in a state where its lower surface is in contact with the upper surface of the sliding support member 50. Since the hanger member 17 is located in the interval between the sliding support members 50, the base plate 10 may move rearward along the sliding support member 50 even if the hanger member 17 protrudes downward on the lower surface thereof. Since the sliding support member 50 is located in the interval between the outer frame member 18 and the base plate 10, the outer frame member 18 is prevented from being pulled upward through the interval between the sliding support members 50. Thus, the base plate 10 is pushed rearward in a stable state where its lower surface is in contact with the upper surface of the sliding support member 50.

Figure 27:
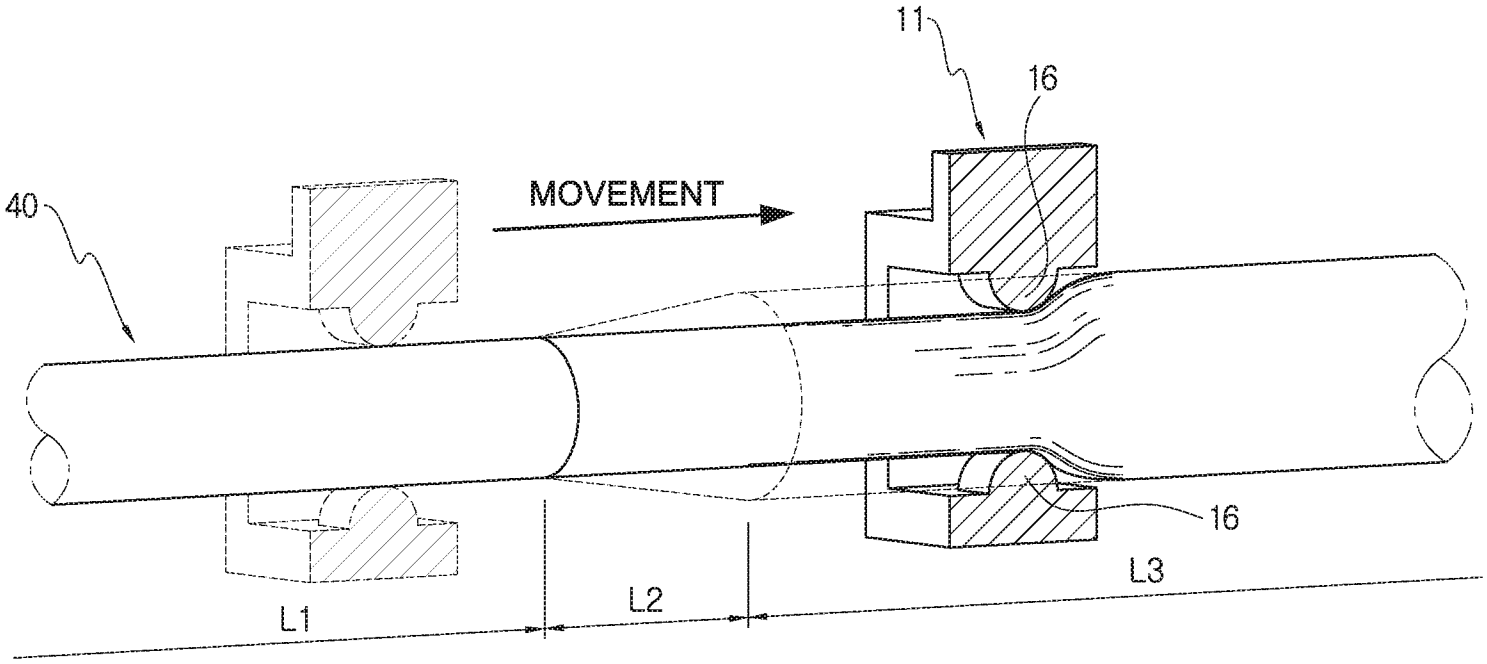
FIG. 27 is a schematic view showing that the pressing member of the present disclosure is moved rearward to dissipate vehicle collision energy.

If the base plate 10 moves rearward, the pressing member 11 provided to the lower surface thereof is also moved rearward along with the base support plate 10 through the interval between the vertical support members 51, namely along the guide trough 3. FIG. 27 shows that the pressing member 11 of the present disclosure moves rearward over the spaced distance and then the close pressing member 16 of the outer frame member 18 presses the outer circumference of the compressive deforming pipe 40 to be compressively deformed. As shown in FIG. 27, if the pressing member 11 passes through the spaced distance forming region L1 and then reaches the diameter changing region L2, the close pressing member 16 provided to the inner surface of the outer frame member 18 starts pressing and deforming the outer circumference of the compressive deforming pipe 40. If the pressing member 11 continues to move rearward, the close pressing member 16 continuously presses and deforms the outer circumference of the compressive deforming pipe 40 as the pressing member 11 passes through the diameter changing region L2 and the compressive deforming region L3. As a result, the collision energy is dissipated.

As described above, the close pressing member 16 may have a semicircular pillar shape, and the convex portion a curved surface may be provided to be oriented toward the center of the perforated portion 180. In this case, the compressive deforming pipe 40 is gradually pressed and deformed due to the curved shape of the close pressing member 16. Accordingly, it is possible to prevent that the compressive deforming pipe 40 is rapidly crushed or the compressive deforming pipe 40 is pressed and compressively deformed in the longitudinal direction.

The diameter changing region L2 having a gradually changing sectional size is present between the spaced distance forming region L1 and the compressive deforming region L3 of the compressive deforming pipe 40. Thus, the compressive deforming pipe 40 is compressively deformed not suddenly but gradually. Accordingly, it is possible to prevent the collision energy from being suddenly dissipated, thereby preventing the post body 1 and the colliding vehicle from being decelerated rapidly and ensuring safe protection of the vehicle occupant more effectively.

In the present disclosure, no residue remains in the guide trough 3 while the compressive deforming pipe 40 serving as a collision energy absorbing member is deformed. If an obstacle is present in the guide trough 3 to disturb the rearward movement of the post body 1, the moving speed of the post body 1 may decrease rapidly or irregularly, resulting in a significant impact on the occupant of the colliding vehicle or causing disadvantageous movement of the occupant. However, in the present disclosure, even though the compressive deforming pipe 40 is elongated in the longitudinal direction as the outer circumference thereof is pressed and deformed by the pressing member 11, the compressive deforming pipe 40 is not crushed and does not generate residues such as fragments. Thus, there is no obstacle in the guide trough 3 that prevents the movement of the post body 1. Thus, after the collision of the vehicle, the post body 1 moves rearward while being slowly decelerated, thereby allowing the vehicle to stop slowly and safely without exerting a significant impact on the occupant of the colliding vehicle.

In the configuration where the spaced distance forming region of the compressive deforming pipe 40 is divided into the front fixing end 41 and the continuous portion 42 according to the first embodiment of the present disclosure, the compressive deforming pipe 40 may be divided into the front fixing end 41 and the remainder thereof (a portion other than the front fixing end). When vehicle collision occurs, the remainder thereof other than the front fixing end 41 is compressively deformed actually. Thus, after the impact and collision energy caused by the vehicle collision is sufficiently absorbed and dissipated due to the compressive deformation of the compressive deforming pipe 40, the front fixing end 41 and the continuous portion 42 may be separated, and then only the deformed part, namely the remainder portion other than the front fixing end may be removed and replaced with a new one and then assembled with the front fixing end 41. After that, the post body 1 may be installed again. Thus, the crashworthy post may be restored into a reusable state quickly and easily. Since the compressive deforming pipe 40 may be reused easily and quickly by replacing only a damaged part with a new one, after a vehicle collision accident occurs, the crashworthy post may be installed again quickly at a low cost, thereby maintaining a safe road environment continuously.

Next, the second embodiment of the present disclosure will be described. In describing the second embodiment of the present disclosure, the same features as the first embodiment of the present disclosure will be not explained repeatedly, and different features will be explained in detail. Accordingly, in the figures depicting the second embodiment of the present disclosure, the same reference numerals are used for the same components as the first embodiment.

Figure 28:
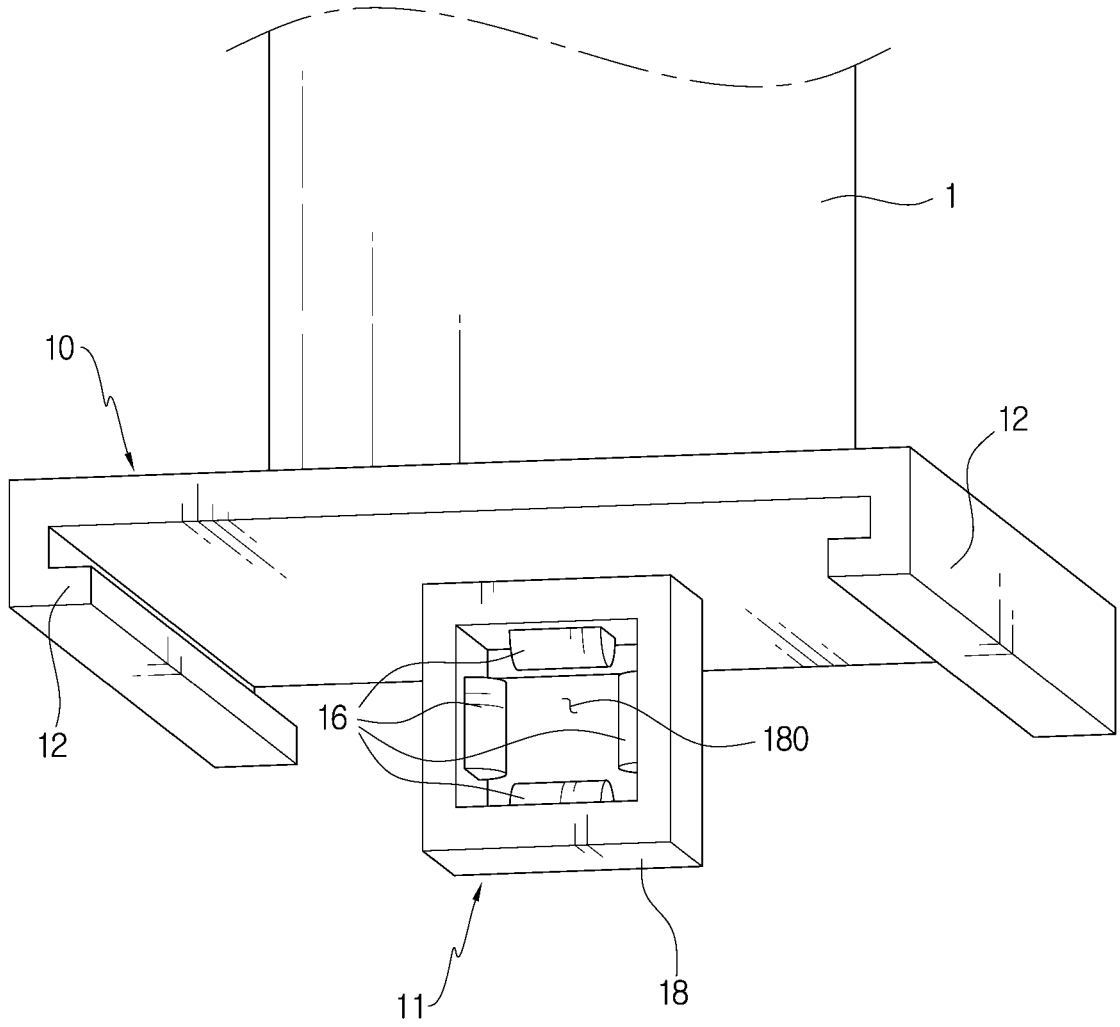
FIG. 28 is a schematic perspective view corresponding to FIG. 11, showing a state where a pressing member is provided to the base plate according to the second embodiment of the present disclosure.
Figure 29:
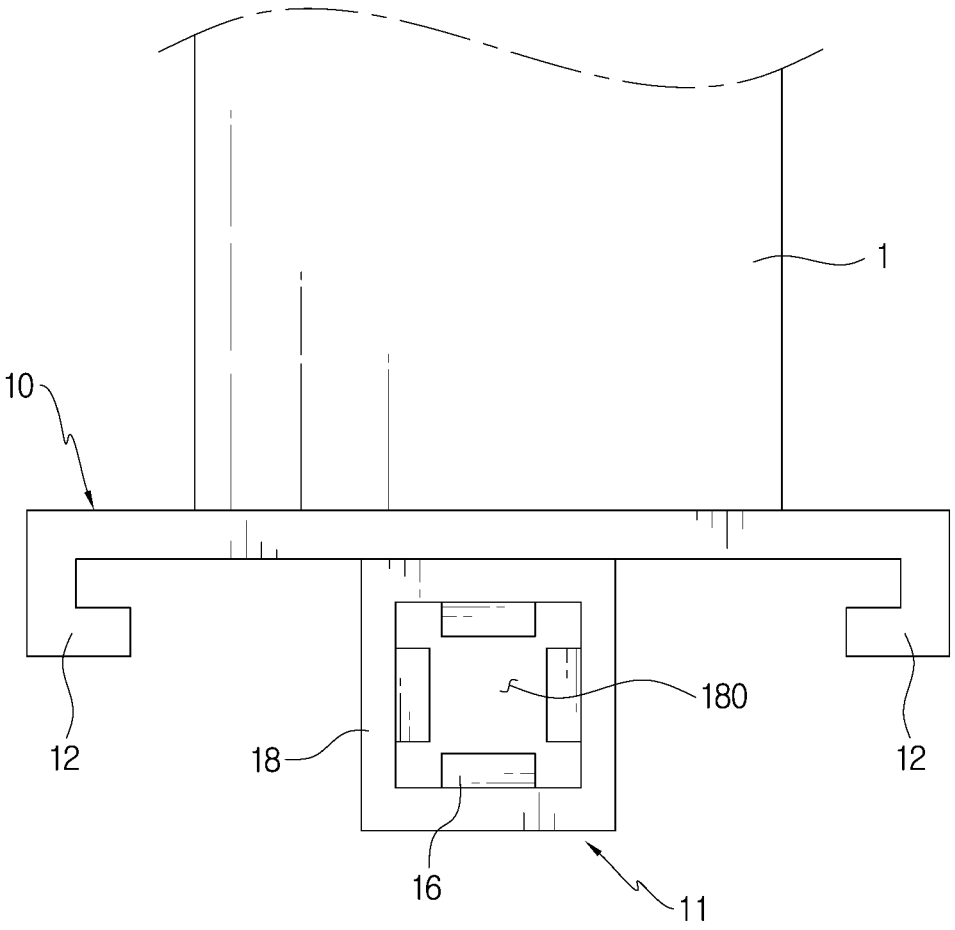
FIG. 29 is a schematic front view corresponding to FIG. 13(A), showing the structure of FIG. 26.

FIG. 28 is a schematic perspective view corresponding to FIG. 11, showing a state where the pressing member 11 is provided to the base plate 10 according to the second embodiment of the present disclosure. FIG. 29 is a schematic front view corresponding to FIG. 13(A), showing the structure of FIG. 26.

In the second embodiment of the present disclosure, the base plate 10 is also integrally provided to the lower end of the post body 1, and the pressing member 11 is integrally provided to the lower surface of the base plate 10. In the second embodiment of the present disclosure, as shown in FIGS. 23 and 24, the outer frame member 18 of the pressing member 11 is directly bonded to the base plate 10 without the hanger member 17. In the second embodiment of the present disclosure, coupling portions 12 with a "U" shape to have an interval in which the sliding support member 50 may be interposed are formed at both lateral sides of the base plate 10 to surround lateral edges of the sliding support member 50.

Figure 30:
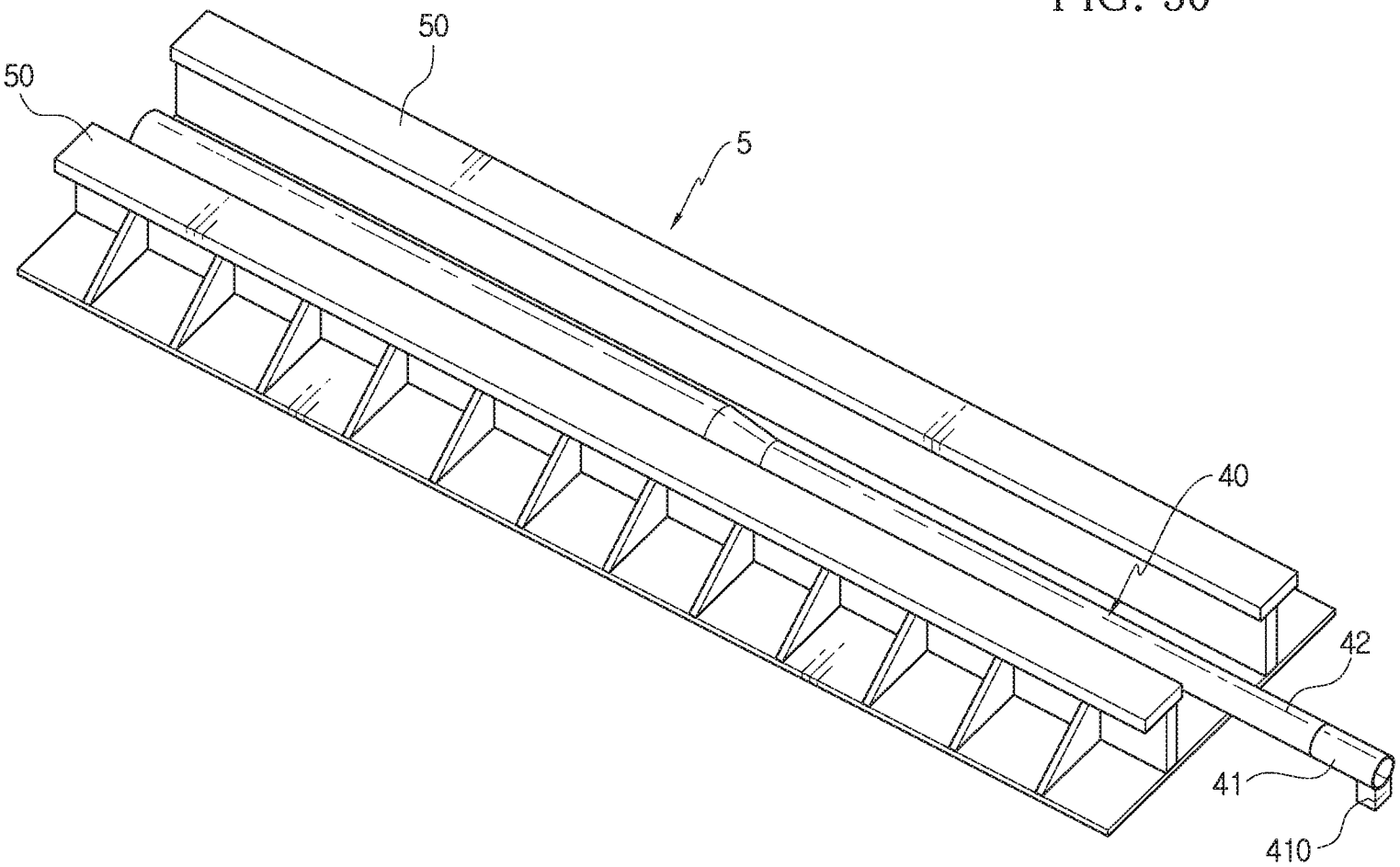
FIG. 30 is a schematic perspective view corresponding to FIG. 3, showing the sliding rail assembly provided in the second embodiment of the present disclosure.
Figure 31:
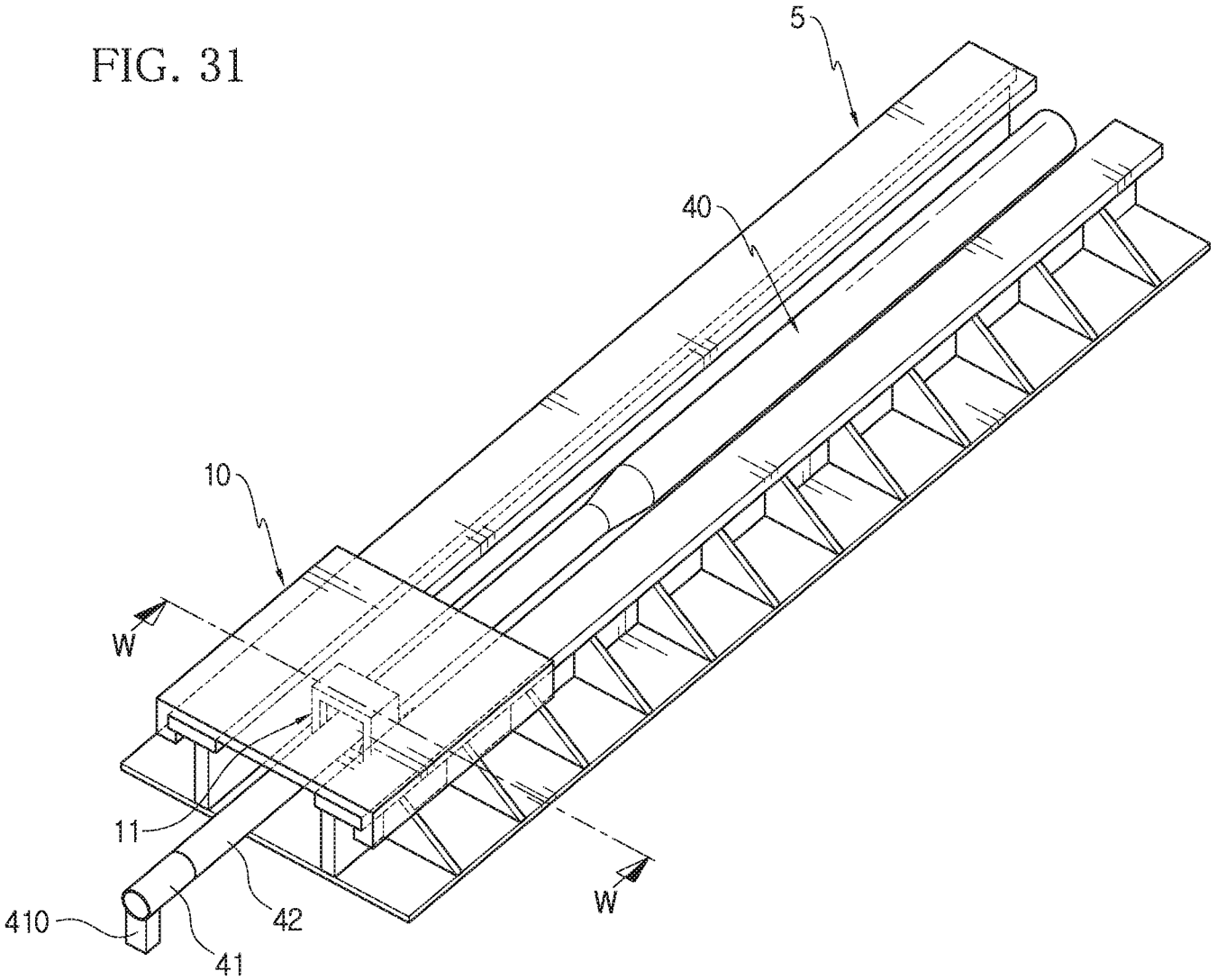
FIG. 31 is a schematic perspective view corresponding to FIG. 14, showing a state where the base plate according to the second embodiment of the present disclosure is assembled to the sliding rail assembly.
Figure 32:
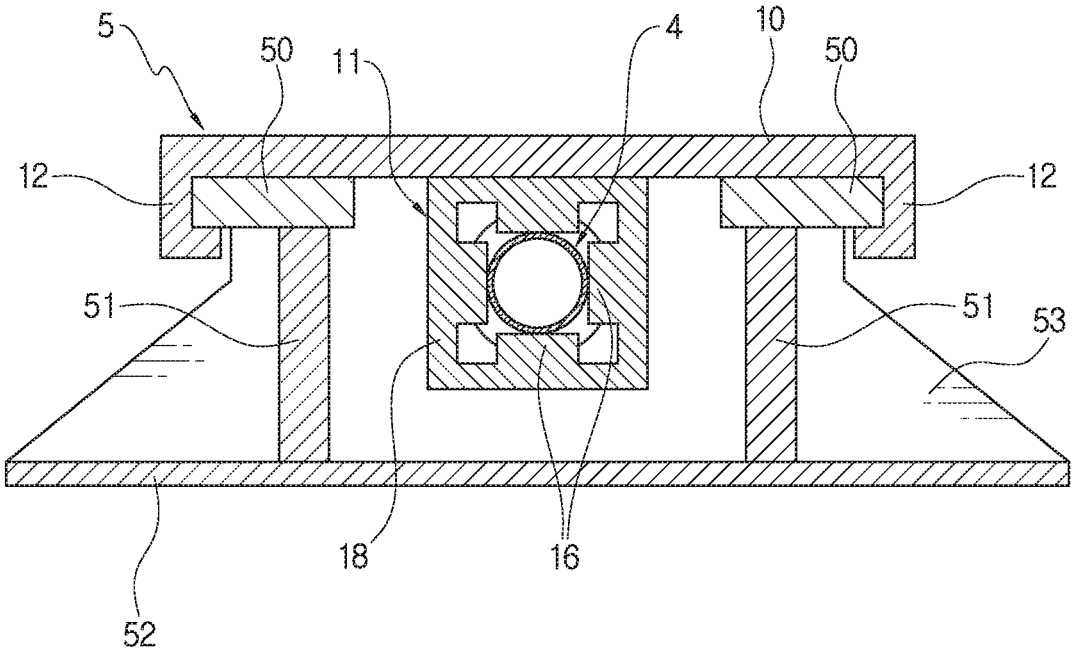
FIG. 32 is a schematic longitudinal sectioned view, taken along the arrow W-W of FIG. 31.

FIG. 30 is a schematic perspective view corresponding to FIG. 3, showing the sliding rail assembly 5 according to the second embodiment of the present disclosure. FIG. 31 is a schematic perspective view corresponding to FIG. 14, showing a state where the base plate 10 is assembled to the sliding rail assembly 5 according to the second embodiment of the present disclosure. FIG. 32 is a schematic longitudinal sectioned view along the arrow W-W of FIG. 31. A pair of sliding support members 50 are provided with a lateral interval. In the second embodiment of the present disclosure, the widening cut portion is not formed at the sliding support member 50. However, the lateral interval between the sliding support members 50 is greater than or equal to the lateral width of the outer frame member 18 attached to the base plate 10. Thus, even in a state where the outer frame member 18 is attached to the lower surface of the base plate 10, the base plate 10 and the pressing member 11 may pass between the sliding support members 50.

In the second embodiment of the present disclosure, the coupling portions 12 are formed at both lateral sides of the base plate 10. Thus, when the base plate 10 is placed on the sliding support member 50 and the pressing member 11 is positioned in the guide trough between two vertical support members 51, as shown in FIG. 32, the sliding support member 50 is interposed in the "U" shaped interval of the coupling portion 12. Thus, when the post body 1 is installed to stand up, the lower surface of the base plate 10 is in close contact with the upper surface of the sliding support member 50.

Figure 33:
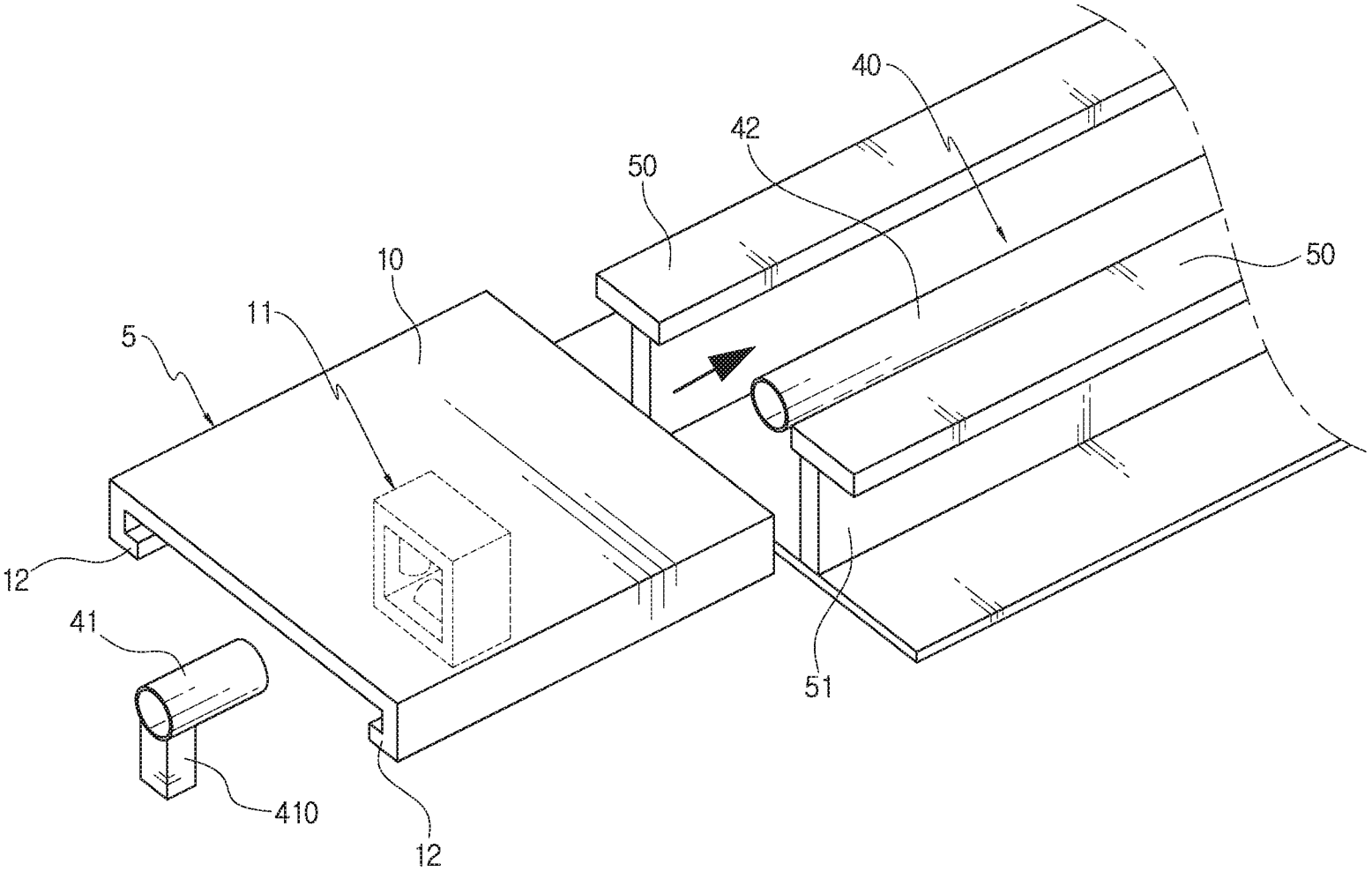
FIGS. 33 and 34 are schematic exploded perspective views for illustrating that the base plate and the sliding rail assembly according to the second embodiment of the present disclosure are assembled in different ways.

FIG. 33 is a schematic exploded perspective view for illustrating a process of "assembling the base plate 10 and the sliding rail assembly 5" according to the second embodiment of the present disclosure. In FIG. 33, the spaced distance forming region L1 of the compressive deforming pipe 40 is also divided into the front fixing end 41 and the continuous portion 42. In addition, the fixing part 410 for fixing the compressive deforming pipe 40 is fixed to the ground at a front position of the bottom member 52 deviating from the bottom member 52, and the front fixing end 41 of the compressive deforming pipe 40 is coupled thereto. In this configuration, first, the front fixing end 41 and the continuous portion 42 of the compressive deforming pipe 40 are separated, and the pressing member 11 is positioned between the front fixing end 41 and the continuous portion 42. Subsequently, the base plate 10 is moved rearward so that the sliding support member 50 is interposed in the "U" shaped interval of the coupling portion 12. The continuous portion 42 of the compressive deforming pipe 40 is moved forward so that the continuous portion 42 is interposed in the perforated portion 180 formed in the outer frame member 18 of the pressing member 11. The continuous portion 42 is assembled with the front fixing end 41 again to be tightly integrated. By doing so, the base plate 10 and the sliding rail assembly 5 are reassembled. It is also possible that, after the continuous portion 42 is interposed in the perforated portion 180 of the outer frame member 18, the base plate 10 is moved rearward so that the sliding support member 50 is interposed in the "U" shaped interval of the coupling portion 12. The process of separating the front fixing end 41 and the continuous portion 42 of the compressive deforming pipe 40, interposing the continuous portion 42 in the perforated portion 180 of the outer frame member 18 and then coupling the continuous portion 42 with the front fixing end 41 again for continuous operation is substantially identical to the above explanation of FIG. 16.

Figure 34:
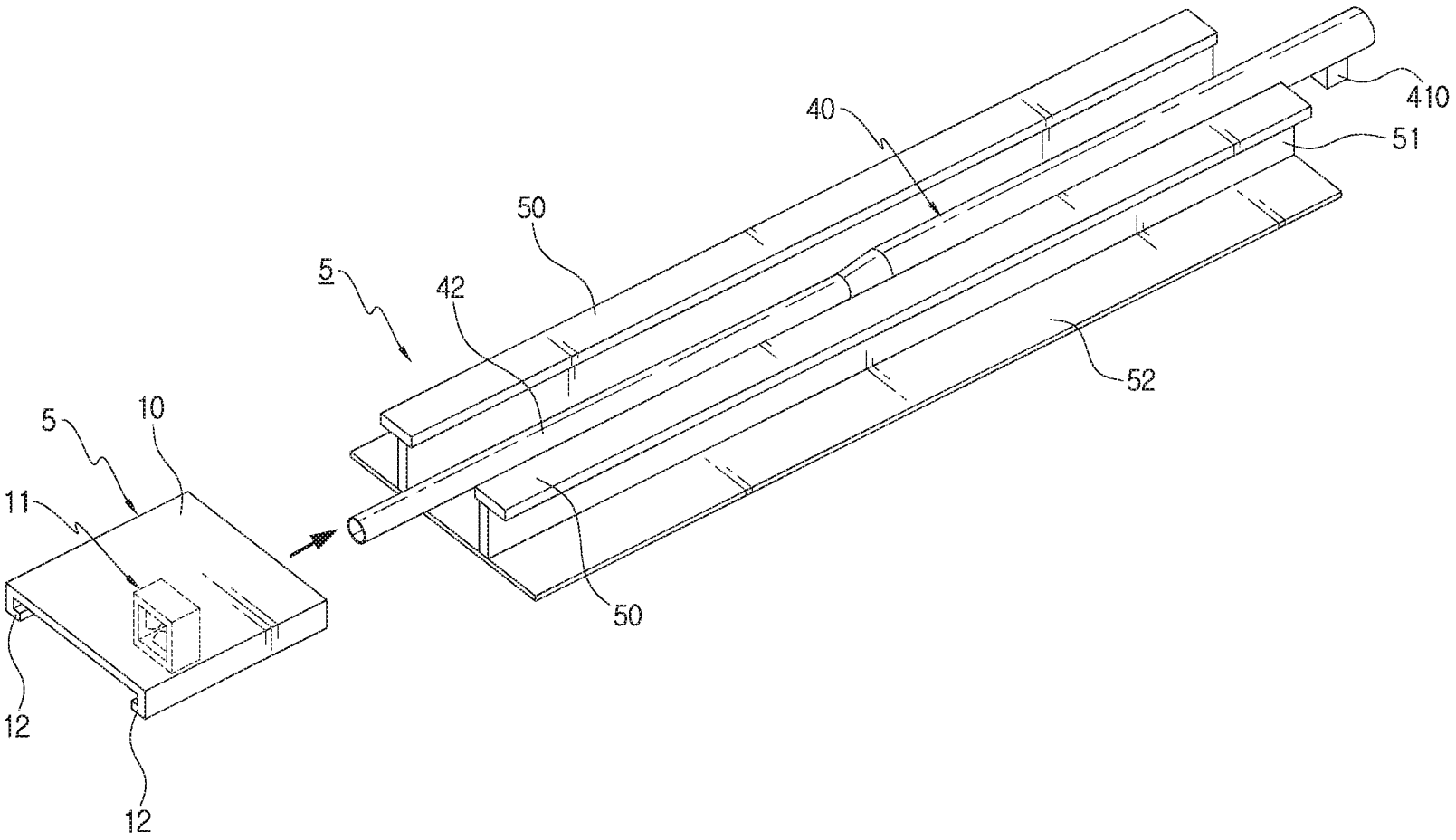

The second embodiment of the present disclosure may be applied even when the rear end of the compressive deforming pipe 40 (the rear end of the compressive deforming region) is coupled to the fixing part 410 as shown in FIG. 9. FIG. 34 is a schematic exploded perspective view corresponding to FIG. 33, showing "the work for assembling the base plate 10 and the sliding rail assembly 5" according to the second embodiment of the present disclosure in a state where the rear end of the compressive deforming pipe 40 is coupled to the fixing part 410. In the configuration where the rear end of the compressive deforming pipe 40 is coupled to the fixing part 410, it is not necessary to divide the spaced distance forming region L1 of the compressive deforming pipe 40 into the fixing end 41 and the continuous portion 42. In addition, in order to perform "the work for assembling the base plate 10 and the sliding rail assembly 5", as shown in FIG. 34, the base plate 10 is positioned at the foremost side of the sliding support member 50, namely the foremost side of the sliding rail assembly, and then the base plate 10 is moved rearward so that the sliding support member 50 is interposed in the "U" shape interval of the coupling portion 12. If the continuous portion 42 of the compressive deforming pipe 40 is moved so that the continuous portion 42 is interposed in the perforated portion 180 formed in the outer frame member 18 of the pressing member 11, the pressing member is located in the interval between the sliding support members in a state where the compressive deforming pipe is interposed in the perforated portion 180. When performing "the work for assembling the base plate 10 and the sliding rail assembly 5" as shown in FIG. 34, the fixing part 410 may be placed on the bottom member 52 at a rear position of the bottom member 52 and installed to be integrated with the bottom member 52, if necessary.

The base plate 10 and the sliding rail assembly 5 are assembled according to the method shown in FIG. 33 or FIG. 34, and the work for constructing the base member 2 and the work for assembling and the post body 1 are performed simultaneously or sequentially to completely install the crashworthy post 100. Similar to the first embodiment described above, in the second embodiment of the present disclosure, if the vehicle collides with the post body 1, the vehicle, the post body 1 and the base plate 10 move rearward. As the pressing member 11 moves rearward, the outer frame member 18 presses and compressively deforms the outer circumference of the compressive deforming pipe 40. The collision energy of the vehicle is dissipated by the compressive deformation of the compressive deforming pipe 40. In the second embodiment of the present disclosure, the base plate 10 moves rearward in a state where the coupling portion 12 having a "U" shape surrounds the lateral edges of the sliding support member 50. Thus, the base plate 10 is pushed rearward in a stable state where its lower surface is kept in contact with the upper surface of the sliding support member 50. As mentioned above, other configurations and effects of the second embodiment of the present disclosure are substantially identical to those of the first embodiment and thus are not described in detail again.

What is claimed is:

1. An energy absorbing post, comprising a base member having a sliding rail assembly embedded therein, a post body installed to the base member, and a base plate provided to a lower end of the post body, wherein the sliding rail assembly includes a pair of sliding support members disposed horizontally with a lateral interval and the base plate placed on an upper surface thereof for sliding on the pair of sliding support members, and a pair of vertical support members disposed vertically to support the sliding support members, respectively, to form a guide trough, wherein a compressive deforming pipe elongated in a longitudinal direction and having a sectional diameter gradually increasing rearward is disposed in the guide trough, the compressive deforming pipe having an outer circumference that is compressively deformed to dissipate collision energy caused by a vehicle collision, wherein a pressing member surrounding the outer circumference of the compressive deforming pipe is provided to a lower surface of the base plate, wherein in a state where the post body is coupled to the sliding rail assembly to stand up such that the base plate is placed on the upper surface of the sliding support member and the pressing member is disposed at the guide trough to surround the outer circumference of the compressive deforming pipe, when a vehicle collides with the post body, the pressing member moves rearward along with a rearward movement of the post body to press and deform the outer circumference of the compressive deforming pipe, so that the collision energy is absorbed and dissipated by the compressive deformation of the compressive deforming pipe to decelerate and stop the vehicle, wherein the compressive deforming pipe is divided into regions, comprising a spaced distance forming region having a small diameter, a diameter changing region changing from the small diameter to a large diameter and a compressive deforming region having the large diameter, from the front to the rear in the longitudinal direction, wherein the compressive deforming pipe is disposed to be spaced apart from a bottom of the guide trough without moving in the longitudinal direction, wherein the pressing member includes an outer frame member having a perforated portion formed at a center thereof so that the compressive deforming pipe is interposed therein, wherein a close pressing member directly contacting the outer circumference of the compressive deforming pipe to compressively deform the compressive deforming pipe is formed at an inner surface of the perforated portion of the outer frame member, wherein the close pressing member includes a plurality of convex portions made of a semicircular pillar-shaped member to have a curvature and formed at the inner surface of the perforated portion of the outer frame member to be oriented toward a center of the perforated portion, wherein the spaced distance forming region of the compressive deforming pipe is divided into a front fixing end coupled to a fixing part and a continuous portion detachably assembled to the front fixing end, wherein the fixing part is fixed to the sliding rail assembly or to the ground deviated from a front portion of the sliding rail assembly to prevent the compressive deforming pipe from moving in the longitudinal direction, and wherein the front fixing end of the compressive deforming pipe is coupled to the fixing part so that the compressive deforming pipe is disposed at the guide trough in the form of a cantilever.

2. The energy absorbing post according to claim 1, wherein the pressing member is connected to the base plate by a hanger member that is integral with, and suspends downward from a lower surface of the base plate with the interval, wherein the sliding support member is made of a flat plate, and the lateral interval between the sliding support members is smaller than a lateral width of the pressing member, wherein a widening cut portion is formed at the lateral interval between the sliding support members at the front portion of the sliding rail assembly, and wherein in a state where the front fixing end and the continuous portion are separated from each other at a location where the widening cut portion is formed, when the base plate is placed on the sliding support member, the pressing member vertically moves downward to the widening cut portion to be located at the lateral interval between the vertical support members, and then, when the base plate is pushed rearward, the pressing member is located below the sliding support member in a state where the compressive deforming pipe is interposed in the perforated portion, the hanger member is located at the lateral interval between the sliding support members, and the base plate is placed on the upper surface of the sliding support member.

3. The crashworthy post according to claim 1, wherein the pressing member is directly attached to the lower surface of the base plate, wherein the sliding support member is made of a flat plate material, and the lateral interval between the sliding support members is equal to or greater than a lateral width of the pressing member, wherein coupling portions with a "U" shape to have an interval into which the sliding support member is interposed are formed at both lateral sides of the base plate to surround lateral edges of the sliding support member, and wherein in a state where the front fixing end and the continuous portion are separated from each other and the pressing member is located between the front fixing end and the continuous portion, the base plate is pushed rearward so that the pressing member is located at the interval between the sliding support members in a state where the compressive deforming pipe is interposed into the perforated portion, the sliding support member is interposed in the interval of the "U" shape of the coupling portion, and the base plate is placed on the upper surface of the sliding support member.

* * * * *